US008523693B2

(12) United States Patent
Nelson

(10) Patent No.: US 8,523,693 B2
(45) Date of Patent: Sep. 3, 2013

(54) MEASURE YOUR SHOT

(76) Inventor: Frank Lee Nelson, Garden City, MO (US)

( * ) Notice: Subject to any disclaimer, the term of this patent is extended or adjusted under 35 U.S.C. 154(b) by 0 days.

(21) Appl. No.: 13/134,961

(22) Filed: Sep. 7, 2011

(65) Prior Publication Data

US 2013/0059671 A1 Mar. 7, 2013

(51) Int. Cl.
*A63D 15/00* (2006.01)
*A63B 37/00* (2006.01)

(52) U.S. Cl.
USPC ..... 473/2; 473/52

(58) Field of Classification Search
USPC ..... 473/2, 4, 1, 52; 33/289; D21/708
See application file for complete search history.

(56) References Cited

U.S. PATENT DOCUMENTS

| | | | | |
|---|---|---|---|---|
| 3,711,091 | A * | 1/1973 | Dixon | 473/2 |
| 3,843,120 | A * | 10/1974 | Ricci | 473/2 |
| 3,947,026 | A * | 3/1976 | Scoutten | 473/2 |
| 3,993,305 | A * | 11/1976 | Nicholson | 473/2 |
| 4,178,694 | A * | 12/1979 | Bonney | 33/289 |
| 5,401,215 | A * | 3/1995 | Pfost | 473/2 |
| 5,597,360 | A * | 1/1997 | Freedenberg | 473/2 |
| 5,716,283 | A * | 2/1998 | Simpson et al. | 473/2 |
| 6,045,450 | A * | 4/2000 | Cyr | 473/2 |
| 6,053,817 | A * | 4/2000 | Fiegel | 473/2 |
| 6,364,783 | B1 * | 4/2002 | Kellogg et al. | 473/2 |
| 6,527,647 | B2 * | 3/2003 | Ringeisen | 473/2 |
| 6,582,316 | B2 * | 6/2003 | Tompert | 473/2 |
| 6,761,643 | B2 * | 7/2004 | Boatwright | 473/2 |
| 6,860,816 | B2 * | 3/2005 | Bond et al. | 473/2 |
| 6,866,590 | B2 * | 3/2005 | Tucker | 473/2 |
| 6,889,982 | B1 * | 5/2005 | Gove | 473/575 |
| D544,930 | S * | 6/2007 | Farrell | D21/713 |
| 7,476,157 | B1 * | 1/2009 | Bertilson | 473/2 |
| 7,658,680 | B2 * | 2/2010 | Malak | 473/2 |
| 8,057,319 | B2 * | 11/2011 | Herbert | 473/2 |
| D655,358 | S * | 3/2012 | Barrett | D21/708 |
| 8,162,771 | B2 * | 4/2012 | Bergstrom | 473/2 |

OTHER PUBLICATIONS

The New Illustrated Encyclopedia of Billilards, by: Michael Ian Shamos; copyright © 1993, 1999, 2002 see pp. 80, 81, 118, 185, 186, 266 and 279.*

* cited by examiner

*Primary Examiner* — Mitra Aryanpour

(57) ABSTRACT

MEASURE YOUR SHOT (M.Y.S.) is a methodology and technology of two billiard balls, each ball including nine (9) one quarter inch (¼") lines scribed 360 degrees, the lines are scaled to diamonds on rails of a billiard table. With the aid of the diamonds and lines it becomes simple for a user and spectators to recognize the type of shot. The training balls provide a tool for improving a user's shot.

5 Claims, 26 Drawing Sheets

MEASURE YOUR SHOT

FIELD OF THE INVENTION

The present invention relates to table games, such as pocket billiards. More specifically, the present invention relates to training balls and a method of using them for the purposes of improving a player's aim in these table games to cause an object ball to roll in the desired direction after being struck by a cue ball.

BACKGROUND OF THE INVENTION

In my prior work, I worked operating cranes. Then I started Research Consultants, investigating large construction accidents, and built scaled mocked-up models in order to reproduce the scene of the accident(s) for the jury in the Superior and Federal Court to see and make decisions. That's how the idea came to me to position lines on the cue balls that is scaled to correspond to the diamonds on the rails of the billiard tables.

Various known aiming systems are available, however, there are no known training balls available that have the correct number of lines scribed 360 degrees around the full circumference of the two inventive blank colored cue balls.

There are no training balls available, that have the visuals to allow a user to see, or the simplicity for the user to use, the present invention provides both the visuals and the use of use as shown and described.

There are numerous books which outline and show all the one, two, and three rail diamond systems. They use the diamonds for banks and kicks, but none of the books scale the ball to the diamonds for precision results if practiced after being taught properly and have the mechanics and talents.

By way of example the following books are available for review:

Billiard Digest

The Science of Pocket Billiards. There are many instructional DVDs on how to do each and every shot and systems, but none I have found with just two balls with 9 nine lines scaled to the diamonds on any pool table.

Kid Delicious Instructional DVD. Show position, play-run out-trick shots, etc. with just regular cue ball plus numbered billiard ball. His aiming system is, a flat plain view of imaginary clock face using face numbers as aiming indicators. (No training ball. copy writes video).

Private Lessons with Don "The Preacher" Feeney. He has a full course of instructional videos. His lessons are also with white cue ball and solid colored balls; no numbers on them. His short course on aiming is Double The Distance, found by locating the imaginary dot on object ball straight in pocket to be shot at. He then rolls his cue tip from center of cue ball to imaginary dot line and rolls cue stick tip that distance again. That is the shooting line.

Bert Kinster of tight pocket production endorses Feeneys system.

C. J. Wiley Ultimate Pool Secrets, An instructional video covering all shots of billiards and trick shots, using regular cue ball plus numbered billiard balls. He has an aiming segment.

The system is parallel lines found by aiming center of object ball to one of four lines on cue ball and at half ball changing to side of object ball to one of four lines on cue ball Also he said he sometimes uses clock face on flat plain view, the numbers on clock are now his aiming lines.

Joe Tucker—Aiming Workout. He has two white cue balls with 19 numbers, 0 in the center and 9 numbers on right side mirrored on left side. My understanding is he matches a right number to a left number to find the contact point. Zero (0) is always to face short rail and 9 faces the long rails.

Jim Rempe has a training ball out. My understanding is he has two sides. One side shows the stop, follow, draw, right English and left English; the other side has a circle with numbers showing how much low, high, left and right on it.

I saw another on UTUBE with cross in the middle.

Another on UTUBE has four red dots; to show rotation is all it is for to my knowledge.

Patent search on Google, and there are many, none like mine.

None of the above references or books lead to the same end result as the present training balls.

SUMMARY OF THE INVENTION

The present invention is generally directed to a device and method of aiming pocket billiard balls for training purposes. In accordance with the present invention, a training ball is used for aiming to impact an object ball for motion of the object ball in a desired direction. The training ball has a series of lines on the outer surface that includes at the equator a center black line and four red lines on each side of the equator. A black cap is positioned on a top and bottom of the training ball.

In operation, the combination cue and object ball are used for training purposes to improve the overall aiming skill of the player. The object ball and the cue ball are placed on the playing surface at a desired position to simulate a given billiard shot. Using the method of the present invention, as described herein, the object ball, relative to the desired aiming line, falls on a given sight line on the playing surface. This sight line determines the angle of the shot to be played and indicates which indicia are to be used on the object ball and the cue ball to impact the object ball to ensure that it is directed on the desired aiming line.

Accordingly, it is a primary object of the instant invention to provide a training ball to improve a player's aiming in the game of billiards.

DETAILED DESCRIPTION

Figure 1:
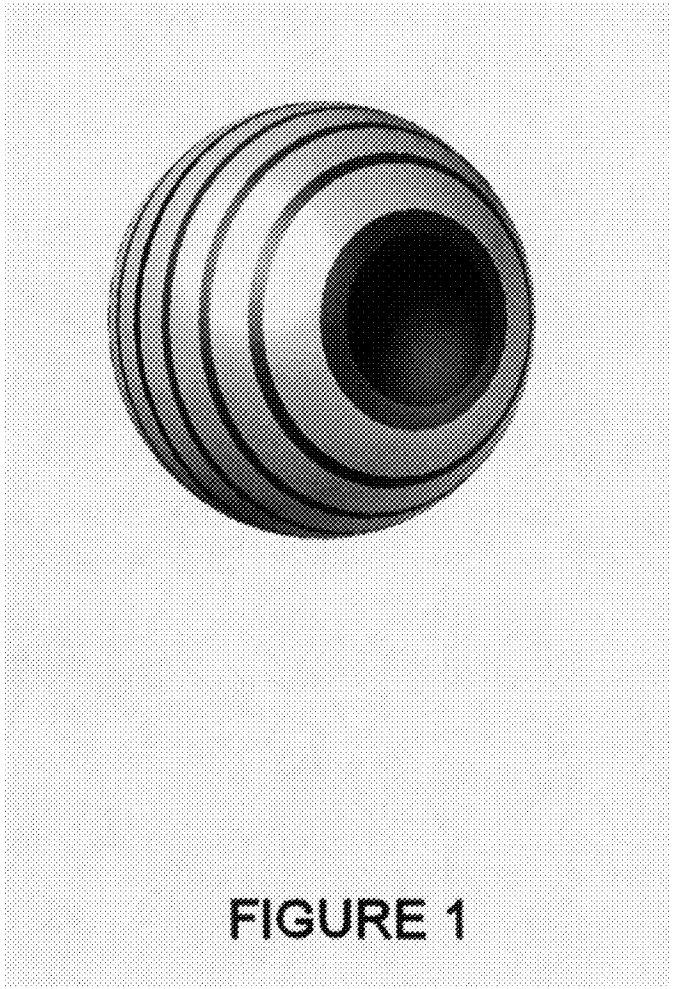
FIG. 1: 3D view of the training ball of the present invention
Figure 2:
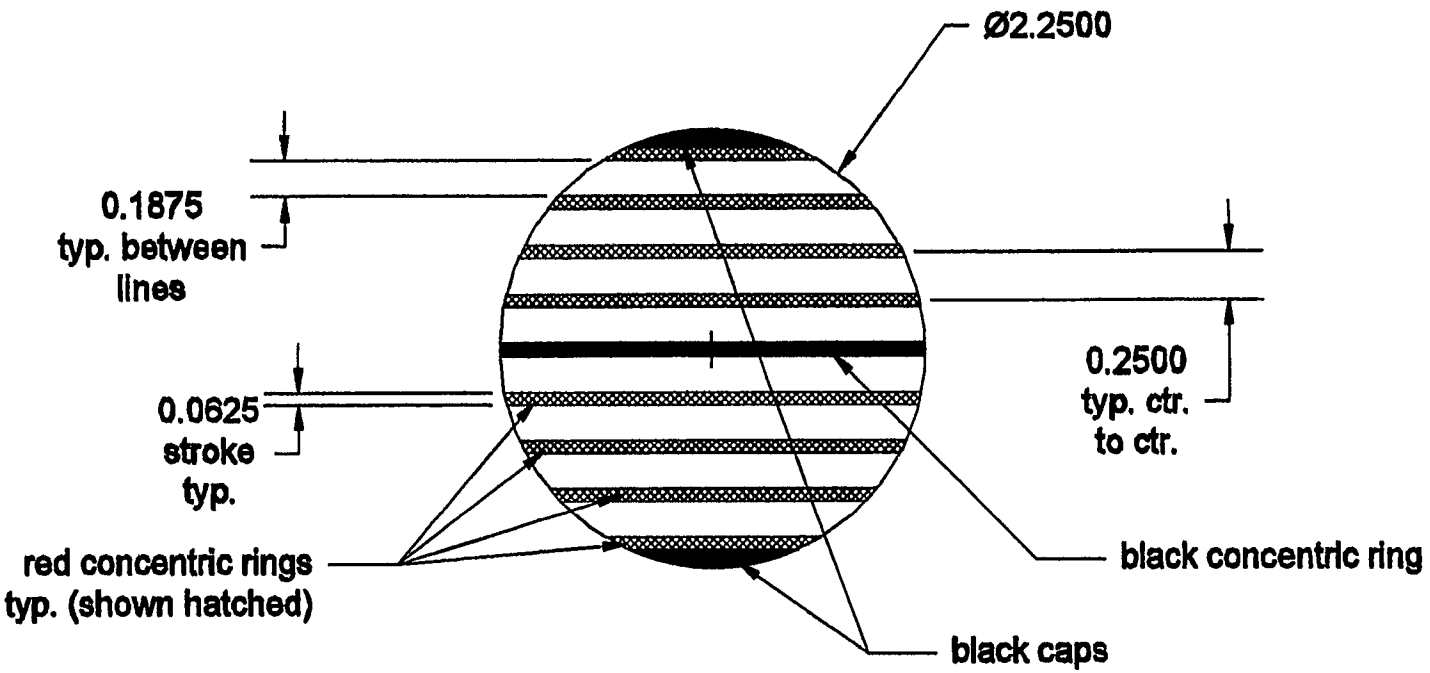
FIG. 2: top view of the training ball of the present invention
Figure 3:
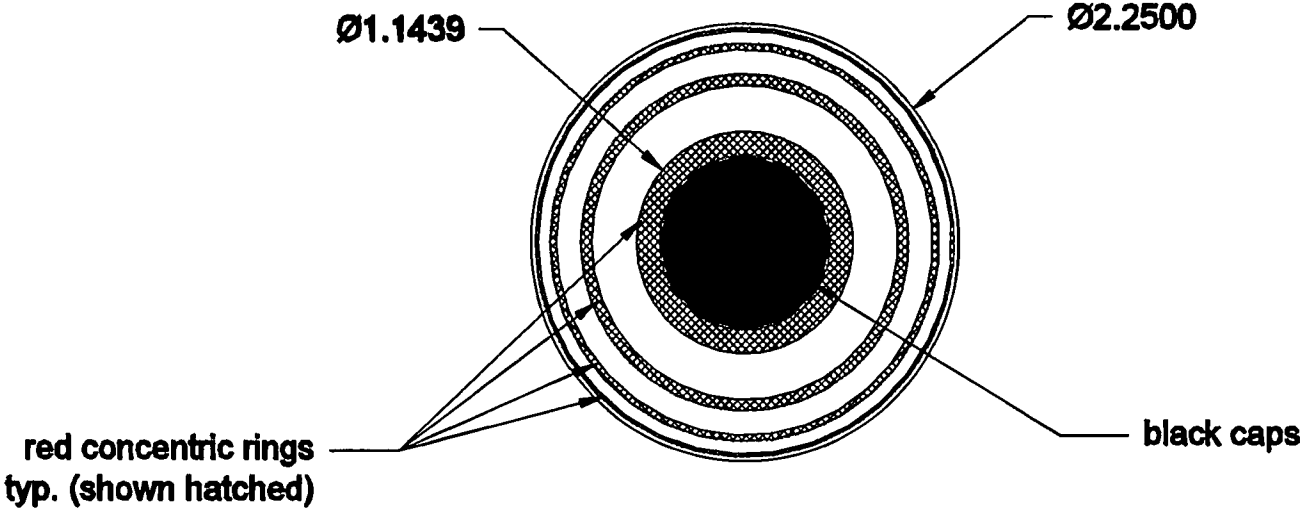
FIG. 3: front view of the training ball of the present invention
Figure 4:
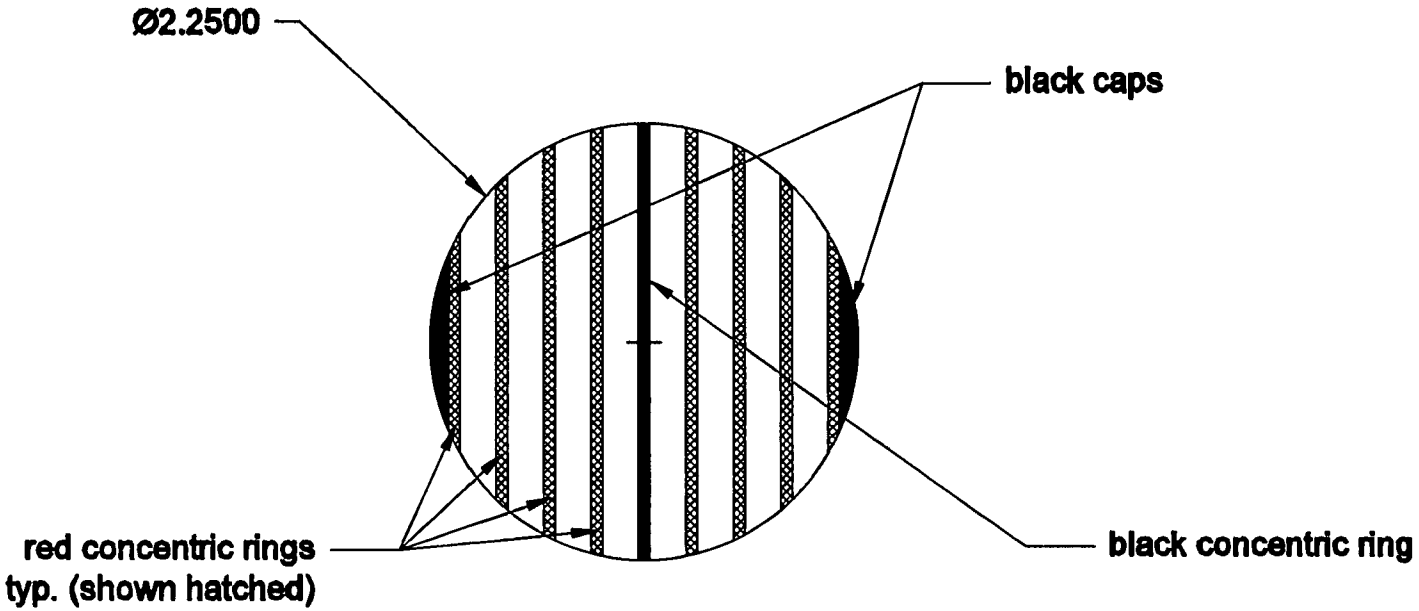
FIG. 4: right side view of the training ball of the present invention
Figure 5:
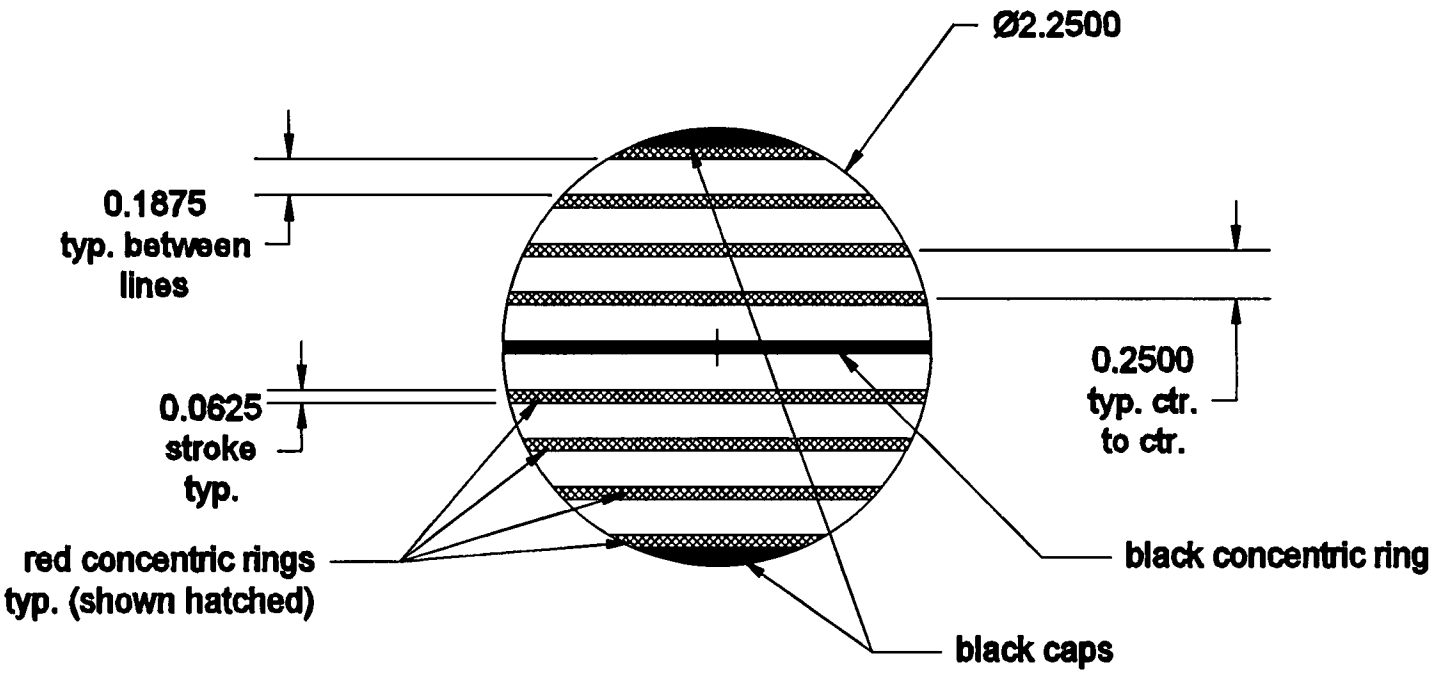
FIG. 5: bottom view of the training ball of the present invention
Figure 6:
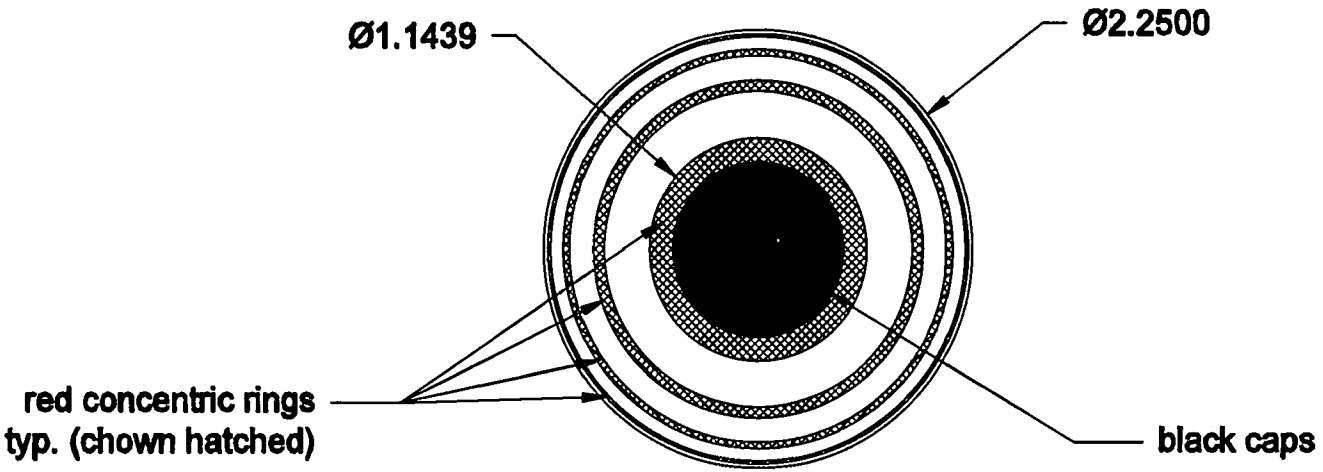
FIG. 6: back view of the training ball of the present invention
Figure 7:
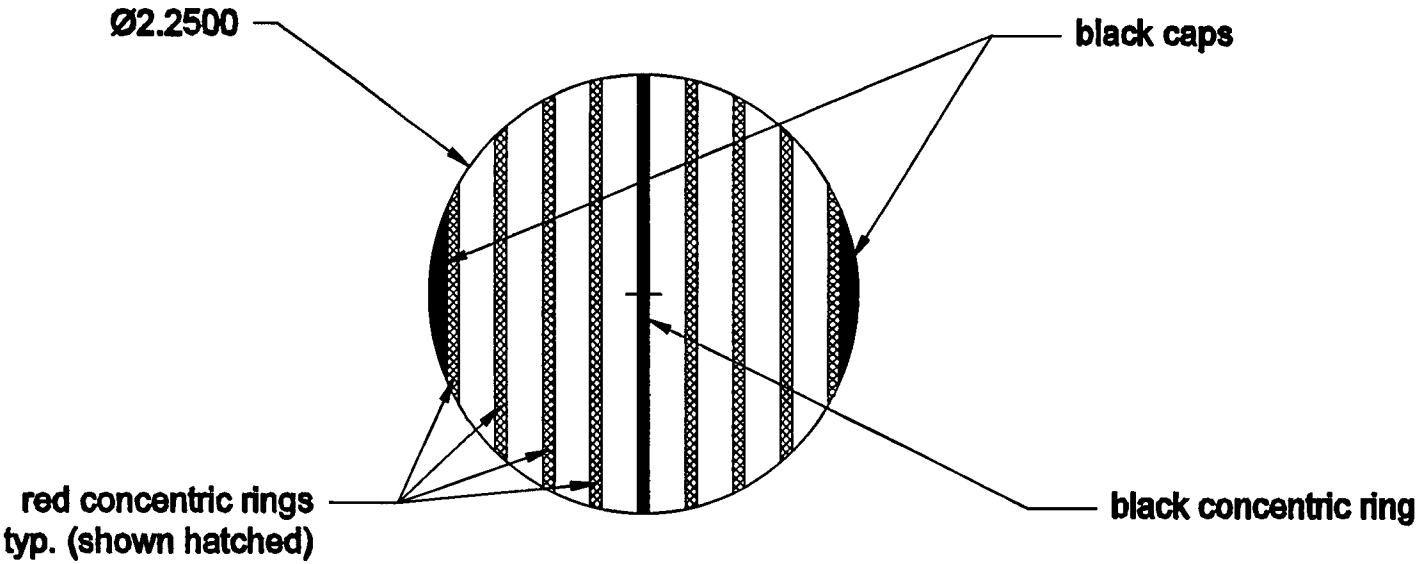
FIG. 7: left side view of the training ball of the present invention

A conventional billiard table includes a plurality of diamonds on each side rail and end rail. In order to design the inventive cue ball, a diamond is placed in each table pocket and three equally spaced diamonds is placed in between each pocket, by doing so, a total of nine (9) diamonds is positioned on each side rail; in total there will be a total of eighteen (18) diamonds positioned on the railing surrounding the playing surface. This leads to six (6) segments of five (5) diamonds in a row on any pool table, the diamonds can be counted easily and quickly from any given pocket.

The inventive lines on the cue balls must be large enough to be visible from a distance of 9 feet. To determine the number and the thickness of the lines on the cue balls the following parameters are taken into consideration: 1) the size of the cue stick tip which ranges in size from 8.5 mm to 16 mm; and the number of diamonds on the side rails of the billiard table which is nine (9). The result is ¼". ¼" is then divided by the diameter of the cue ball which is 2¼" which equals nine (9), therefore nine (9) lines are circumferentially placed on the inventive cue ball.

With the ¼" scale, you can impact the center of the lines with the center of the cue tip, this can be accomplished with any size tip accurately and measured with closer precision.

To determine the aiming line for the object ball as well as selecting the impact point on the training ball/cue ball, first you select the object ball that is going to be pocketed in a straight line, this will be the first bench marker, as in surveying. secondly, you determine the straight line between the cue ball and the object ball. This line comes back to the rail on both balls, this will be the second bench marker. Next, you count the diamonds in between the two bench markers, this will be the line of impact. The drawings clearly show this concept.

Like a legend on a map, ¼" on the ball equals one foot on the table. The lines on the balls, vertical and turned to horizontal, will teach a user how to make all the shots. The lines can be applied on any blank colored cue ball to execute the intended purpose.

The present training ball assists, if not dictates, the feet position for alignment of each shot.

Gives bench markers that not only the player, but T.V. audience plus live audience seated in bleachers, chairs or standing, can identify the shot to be made.

Gives aiming line, shooting line, which in drawings are only cut shots, spin not added, but will be shown in DVD, video and book to follow after patent is awarded.

Gives contact point, which if you explode drawings, is always about ½ of diamond count. Shot angle is available if you choose to use a protractor on straight in bench marker to the diamond count bench marker.

The black center equator line, plus four red lines on each side of the equator, then the black caps has the beauty for ornamental design, but also shows the rotation of the balls while doing the work they were designed to do.

As noted the ball has an equator at the center of the ball which is a black line. There are four red lines on each side of the equator. There is black cap at each side of ball. The caps are approximately one eighth of an inch. The number of lines which is nine (9) is divided by two which equals four and one half (4½). Any shot beyond the ninth line is a fan or miss or you turn the cue ball lose for a scratch, so it leaves a branding space for whoever buys the rights to the designed utility balls for their logo for advertisement.

The drawings not only show the claimed invention but also show all the standard and spin shots that can be made that are not addressed. The lines on the training ball extend are 360 degrees, the full circumference of the sphere. There is one black line in the center (equator), four red lines on right side of black line and four red lines on left side of ball. The black caps on each side, are as thin as a player should ever try to cut for any kind of results, which can also be used for the manufacturers branded logo for sales and marketing. The drawings showing the 3D model show ¾ of the ball as you would see it rolling; the remainder of the ball is mirrored of the other side and bottom. The drawing scale is full size, lines are ¼ inch scale, and the two black caps are ⅛ inch, matched together equal ¼ inch when struck together is a 9 diamond scaled shot, or it can be a spin shot if stance is aligned properly.

The drawings showing a pool table depicts 9 shots that can be made on any size pool table. The two training billiard not only cut the pool shots depicted by the pockets, but also spin the ball in the pockets, using proper alignment for each made shot. The drawings show the shot is from the left side pocket to the right corner pocket, as is indicated by the straight dark lines. The drawings further show an object ball, a ghost ball, a make-believe ball and a fantasy ball making contact, this is the magic-spot all pool players hope to find and hit. "Benchmarker" is a term I am using to describe the straight-in line for the object ball to hit a pocket. The Next "benchmarker" is where the object ball and cue ball are aligned in a straight line, where these two lines strike the rail, the diamond counts-in the lines that match up on the cue ball and the object ball which shows you the actually shooting line. The broken lines depict the diamond count and 1 through 9 shots. For the training ball of this invention to work as intended, a diamond is added in the center of each pocket so a correct count can be obtained.

FIGS. 1-7 show side and top view of the inventive training balls, the back and bottom of the balls are mirror images of the front and top of the balls. The preferred dimensions are as shown in the drawings. The ball indicia which includes a center black line and nine red lines extend 360 degrees on the circumference of the spherical training balls. The center black line is positioned on the equator of each ball, four red lines are positioned above the center black line and four red lines are positioned below the center black line of each ball. A pair of caps, preferably black is positioned on the top and bottom of each ball. It should be noted that the preferred colors for the center line and cap is black and red for the remainder of the lines. However, any other color combination can be used. The caps can be used for positioning manufacturers branded logo. The 3D model shown in FIG. 1, depicts about ¾ of the training ball. A preferred line thickness is ¼" and each cap is ⅛ inch, the thickness of the two caps equals ¼", a side view of the training ball will show nine lines which correspond to the nine diamonds on the table railing. By using the training balls and the nine diamonds a user can practice nine-diamond scale shot or a spin shot if the user's stance is aligned correctly.

Figure 8:
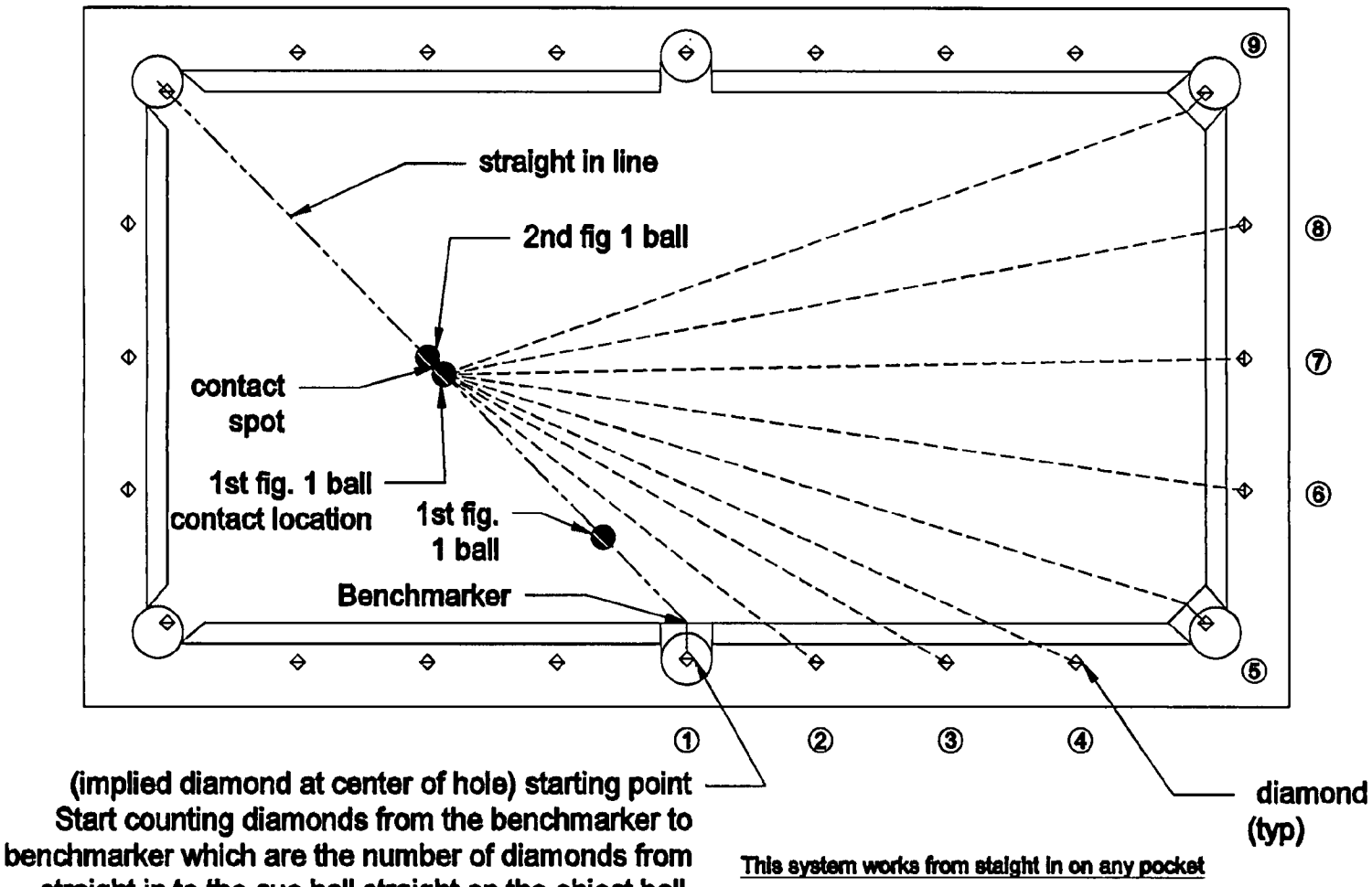
FIG. 8: top view of a billiard table showing the Nine (9) diamond locations
Figure 9:
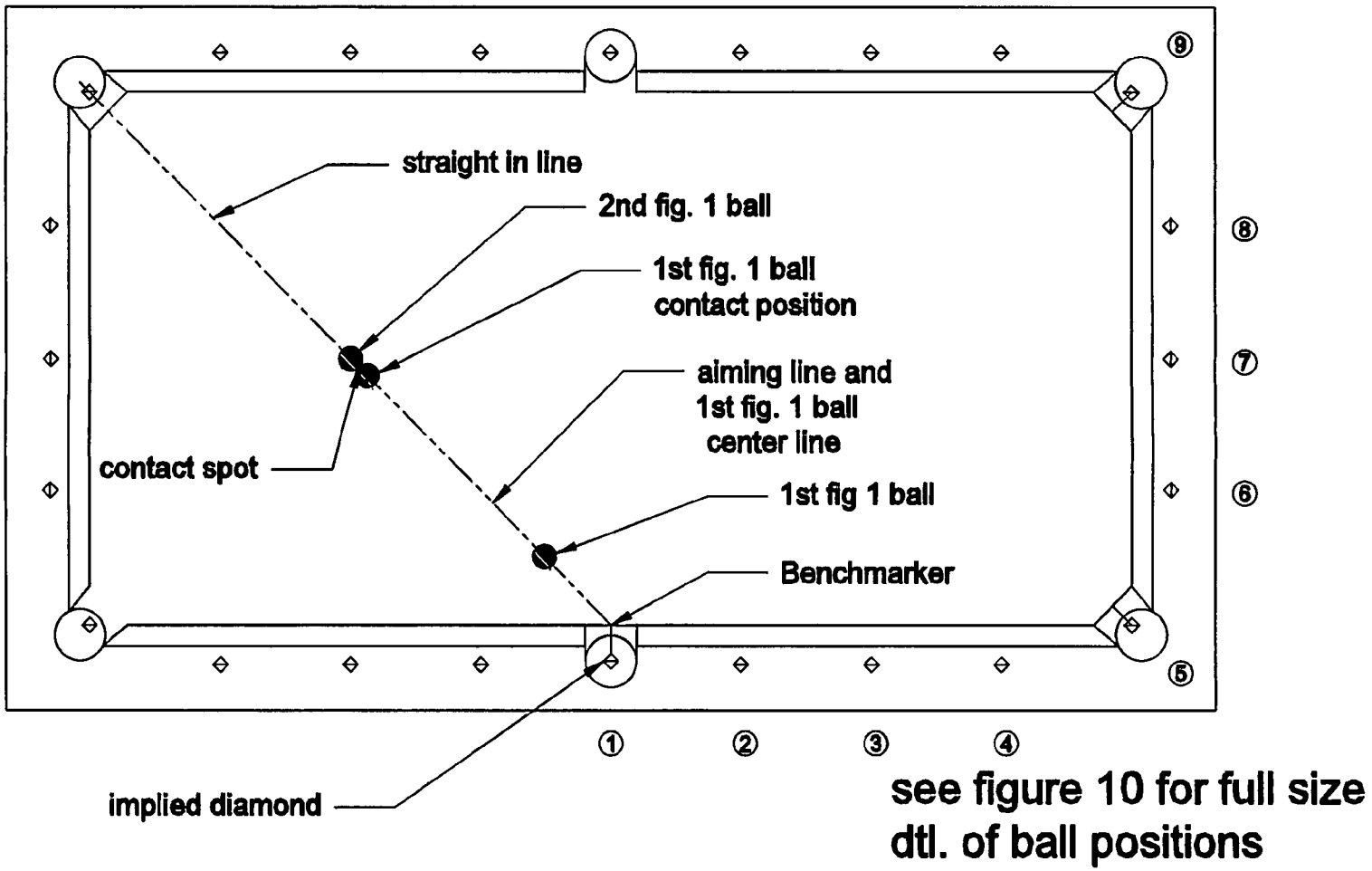
FIG. 9: drawing of 1st diamond shot on the billiard table

FIG. 8, depicts 9 possible shots that can be made on any size pool table. The present invention revolves around properly aligning two training balls which aid in carrying out a correct pool shot while adding spin to the shot.

FIG. 8 also shows the shot is from the left side pocket to right center pocket, this is demonstrated by the solid straight lines. The point between an object ball, a ghost ball, make believe ball or a fantasy ball is the "magic spot" which all pool players hope to find and hit. "Benchmarker" is a term that is used throughout this application for describing the "straight-in" line for the object ball to hit a pocket. The second "benchmarker" is where the object ball and cue ball form a straight line, the diamond from where these two "benchmarker" lines strike the rail, is counted to determine the line number on the training balls, this will allow the user to find the line of shot between the cue ball and the object ball. FIG. 8 also demonstrates in dashed-lines the diamond count for all nine shots. As can be seen for this system to work, a diamond is added in the center of each pocket.

Figure 10:
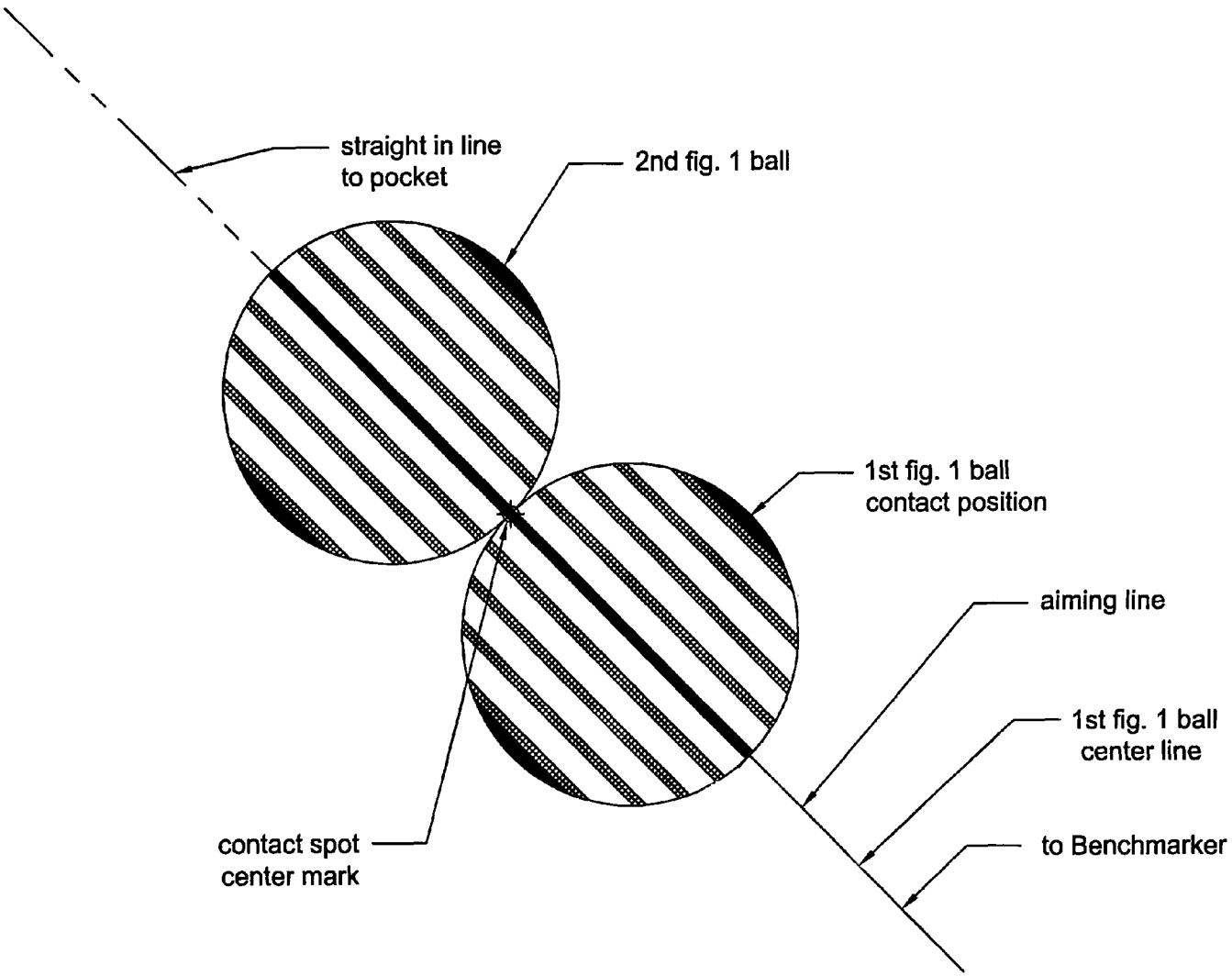
FIG. 10: enlarged drawing of 1st diamond shot ball positions

FIG. 10, depicts the full scale training balls, the straight-in shot is determined by matching the "black line" with the black center line on the training balls.

Figure 11:
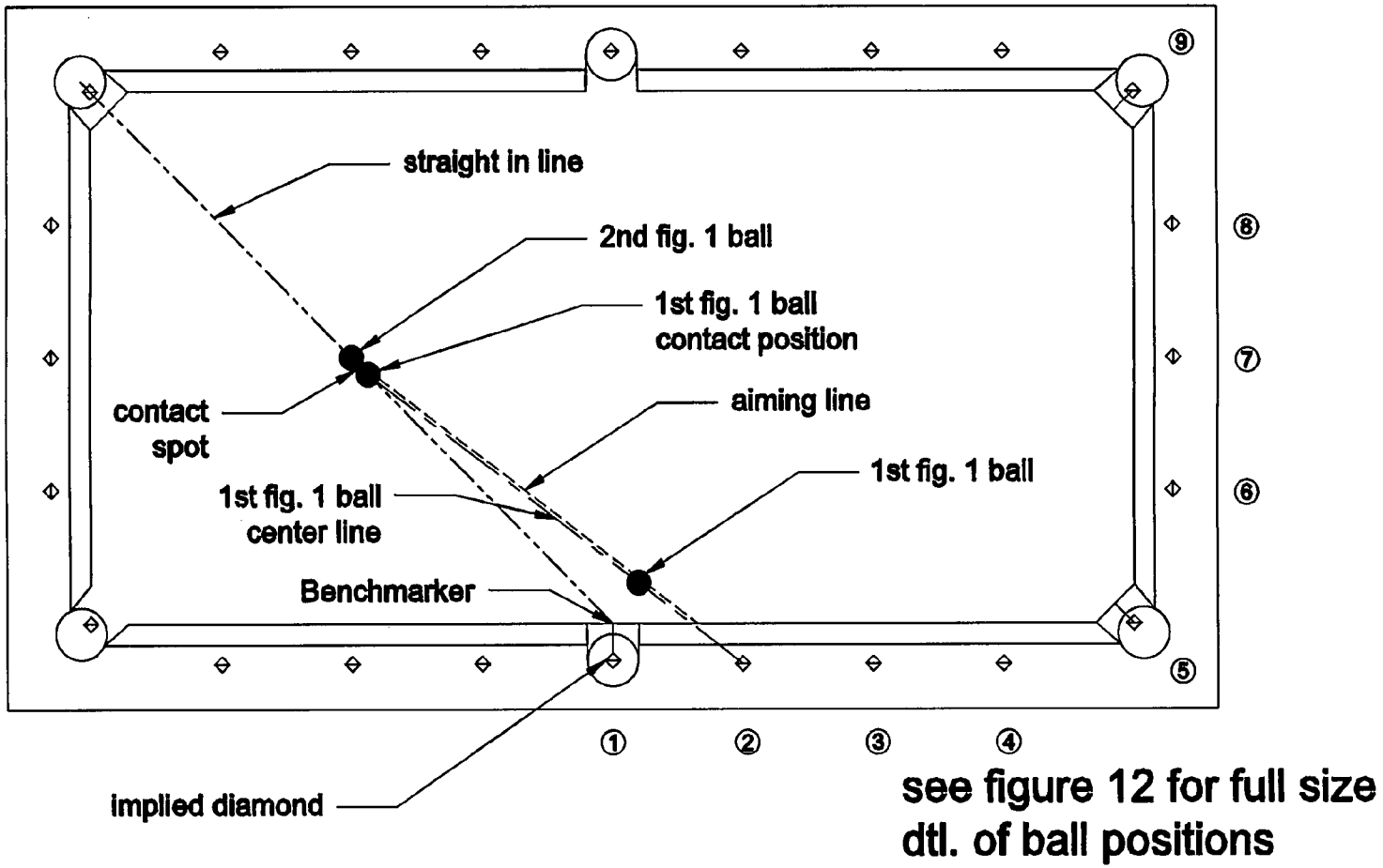
FIG. 11: drawing of 2nd diamond shot on the billiard table

FIG. 11 depicts shot number two, using two diamonds for making a straight-in shot. The dotted lines shown in FIG. 11 are parallel, the prior art does not teach or suggest the use of two parallel lines for making a straight-in shot. The present inventive system of aligning the scaled lines on the training balls with the scaled diamonds on the billiard table is not only simple to use and aids in easily finding and recognizing the correct line of shot, but also dictates to the user proper stance line up, and insists on good mechanics for the user's body.

Figure 12:
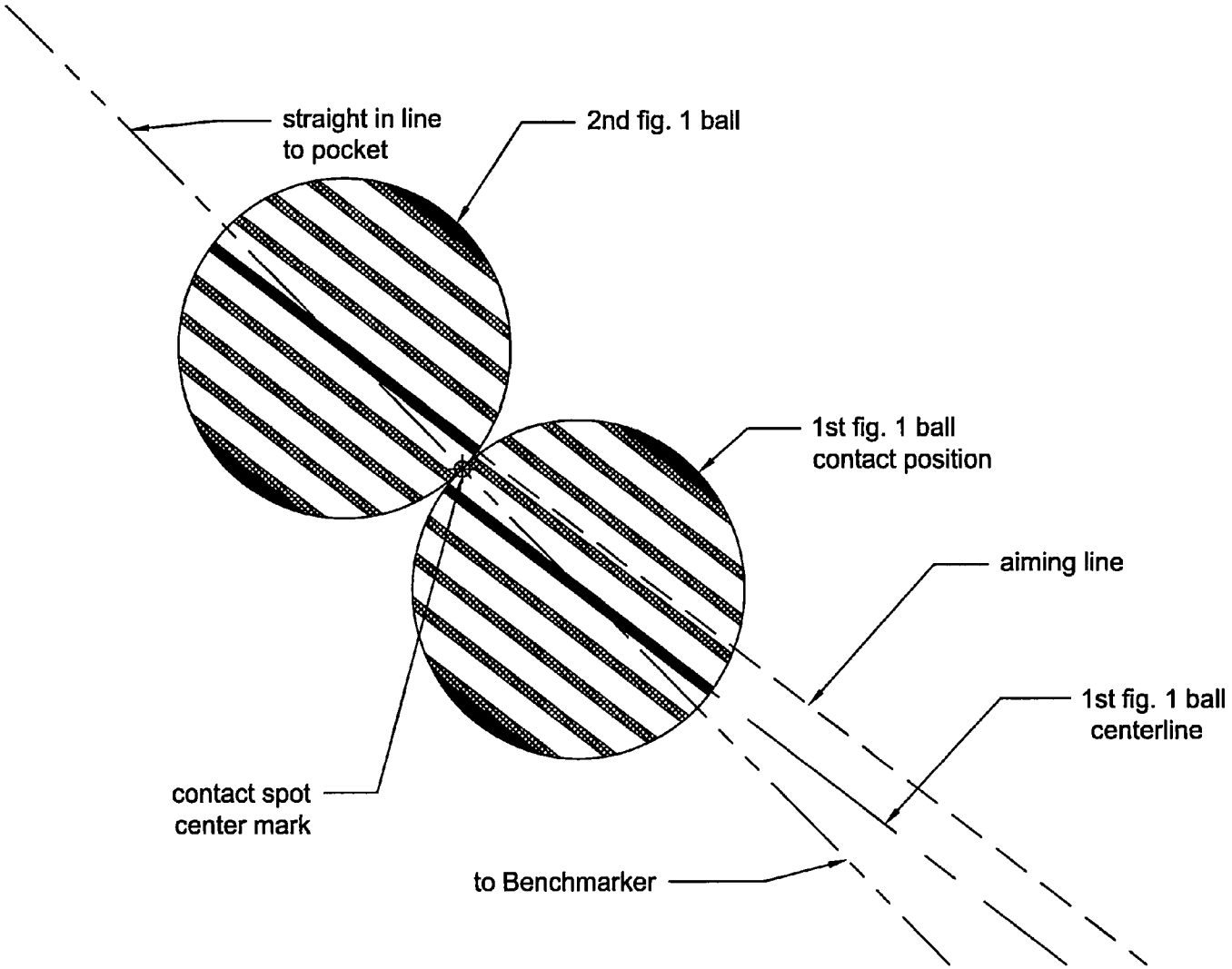
FIG. 12: enlarged drawing of 2nd diamond shot ball positions
Figure 13:
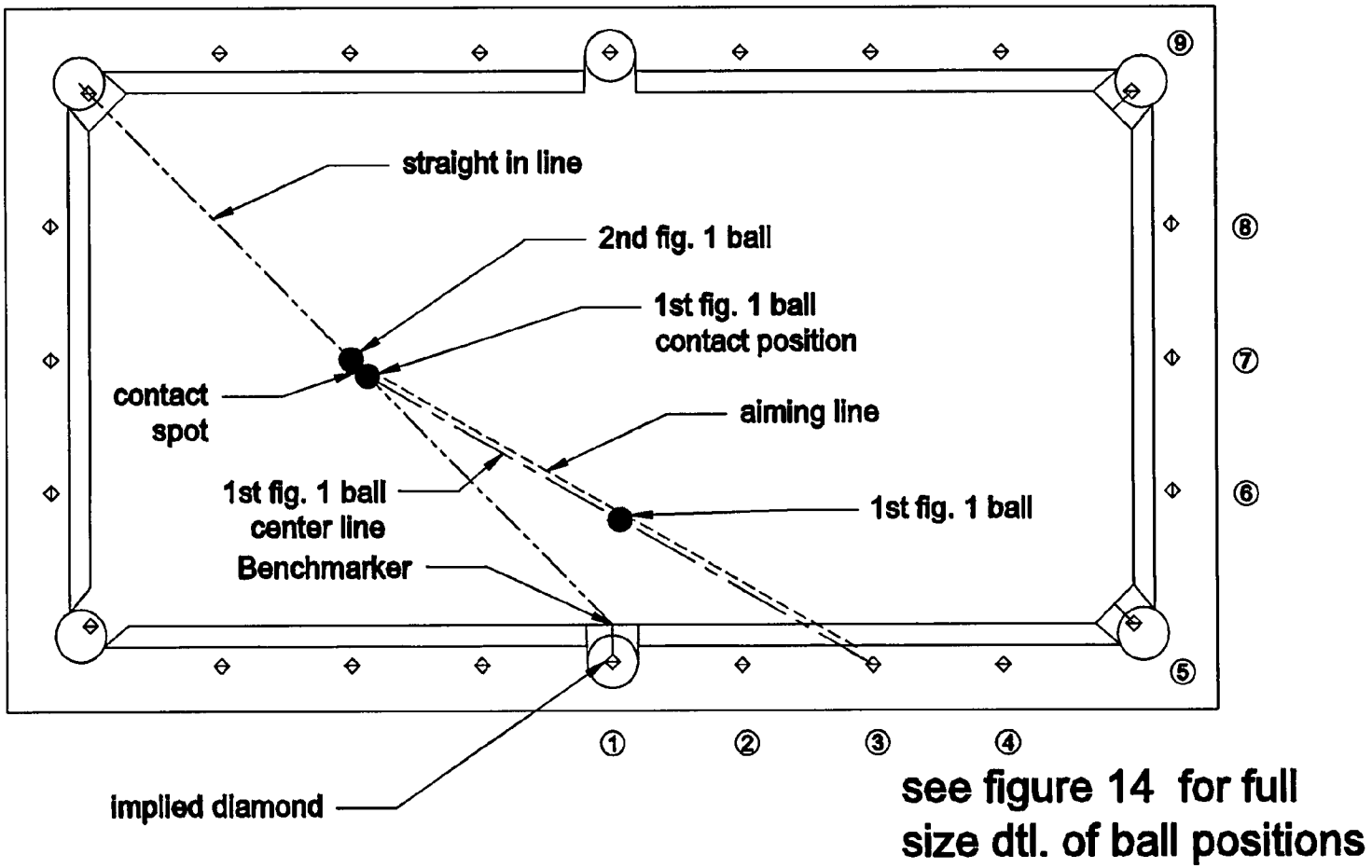
FIG. 13: drawing of 3rd diamond shot on the billiard table
Figure 14:
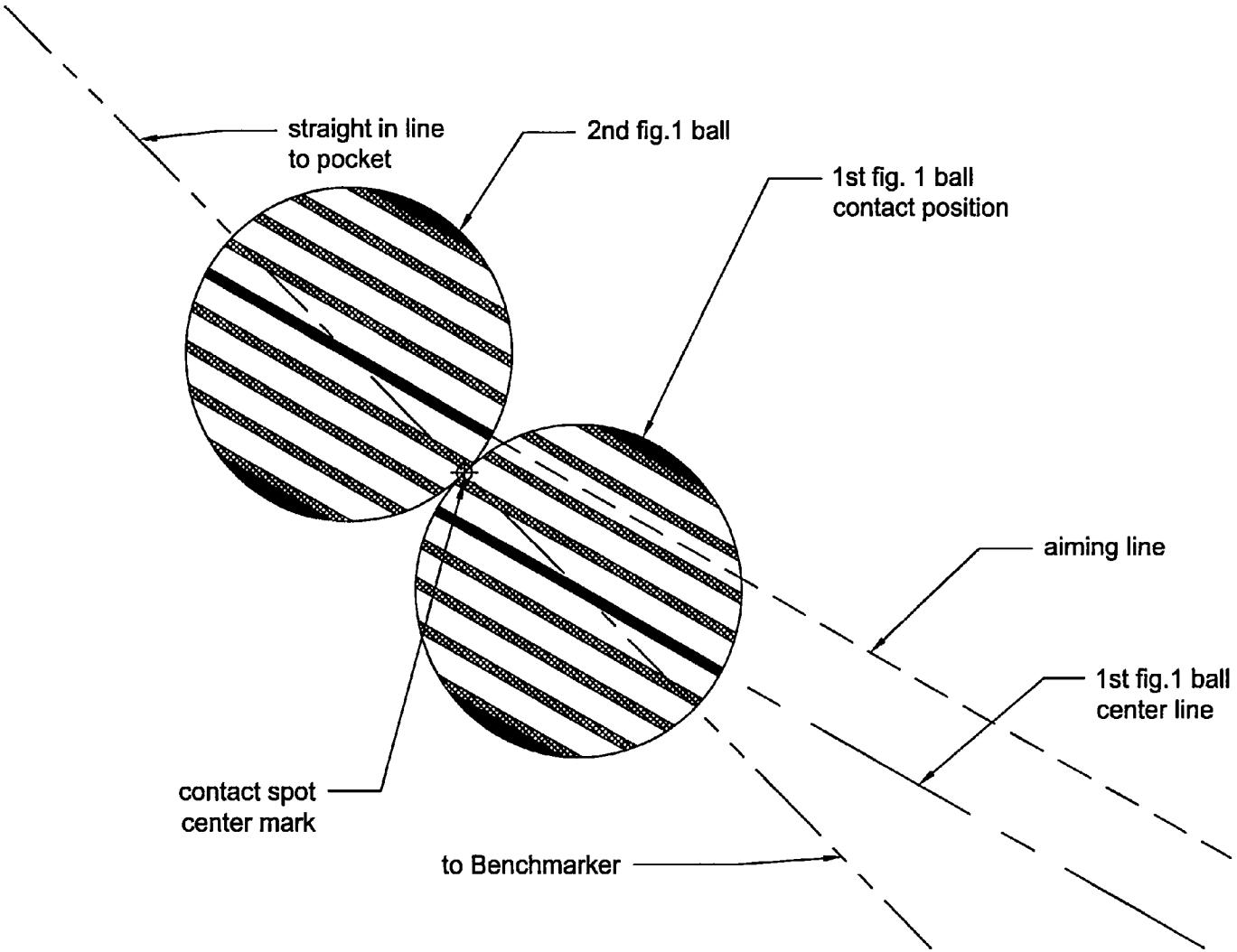
FIG. 14: enlarged drawing of 3rd diamond shot ball positions
Figure 15:
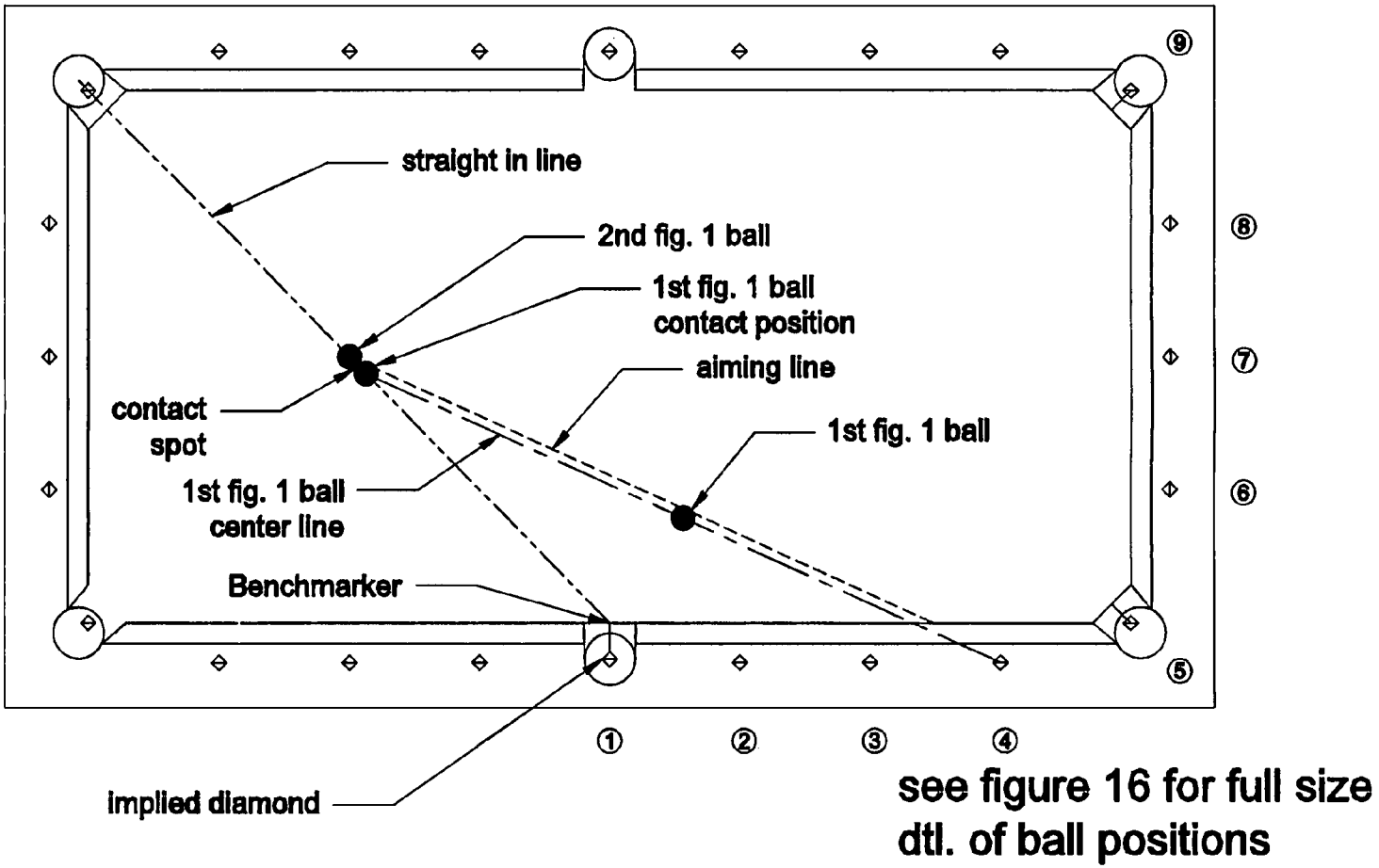
FIG. 15: drawing of 4th diamond shot on the billiard table
Figure 16:
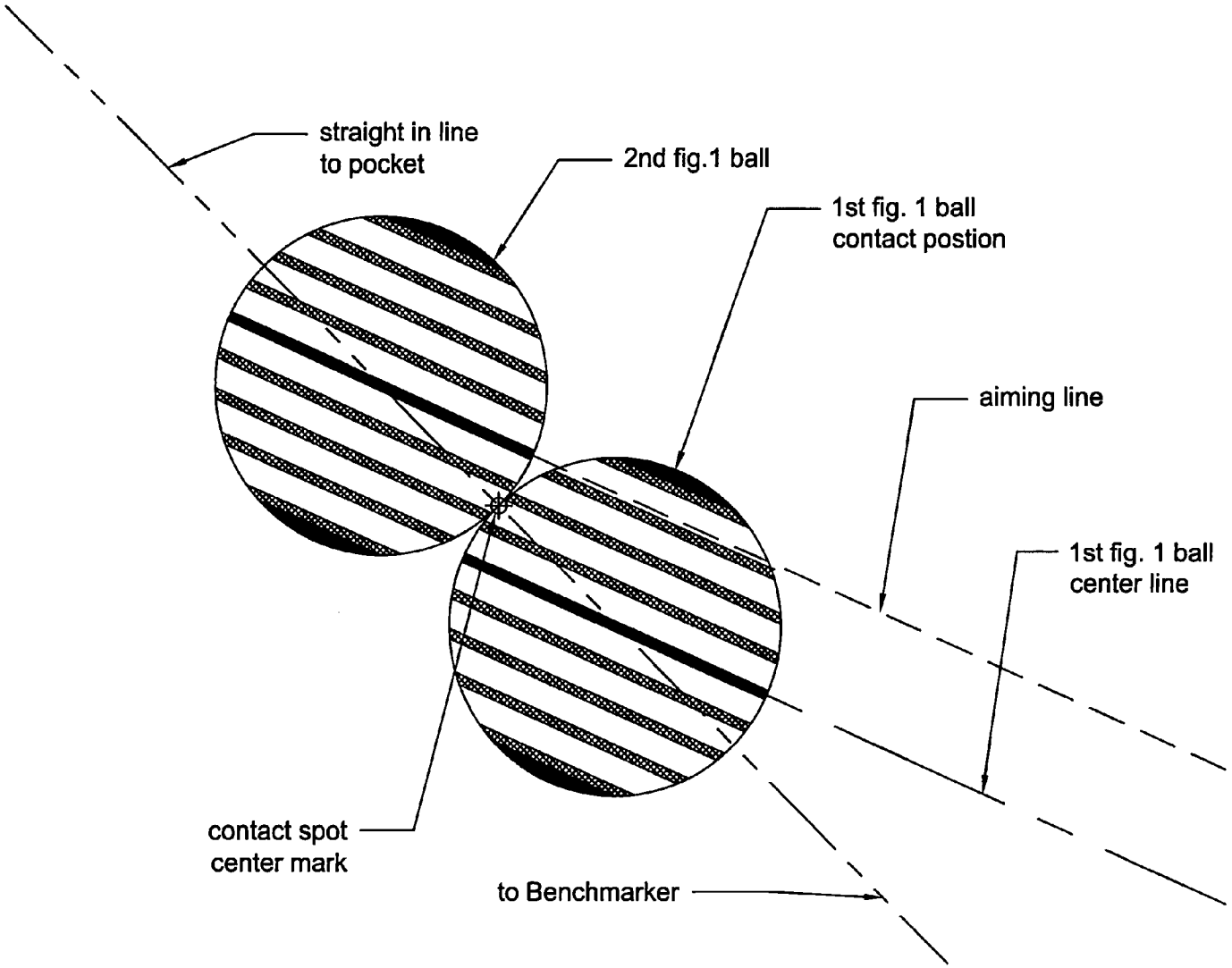
FIG. 16: enlarged drawing of 4th diamond shot ball positions
Figure 17:
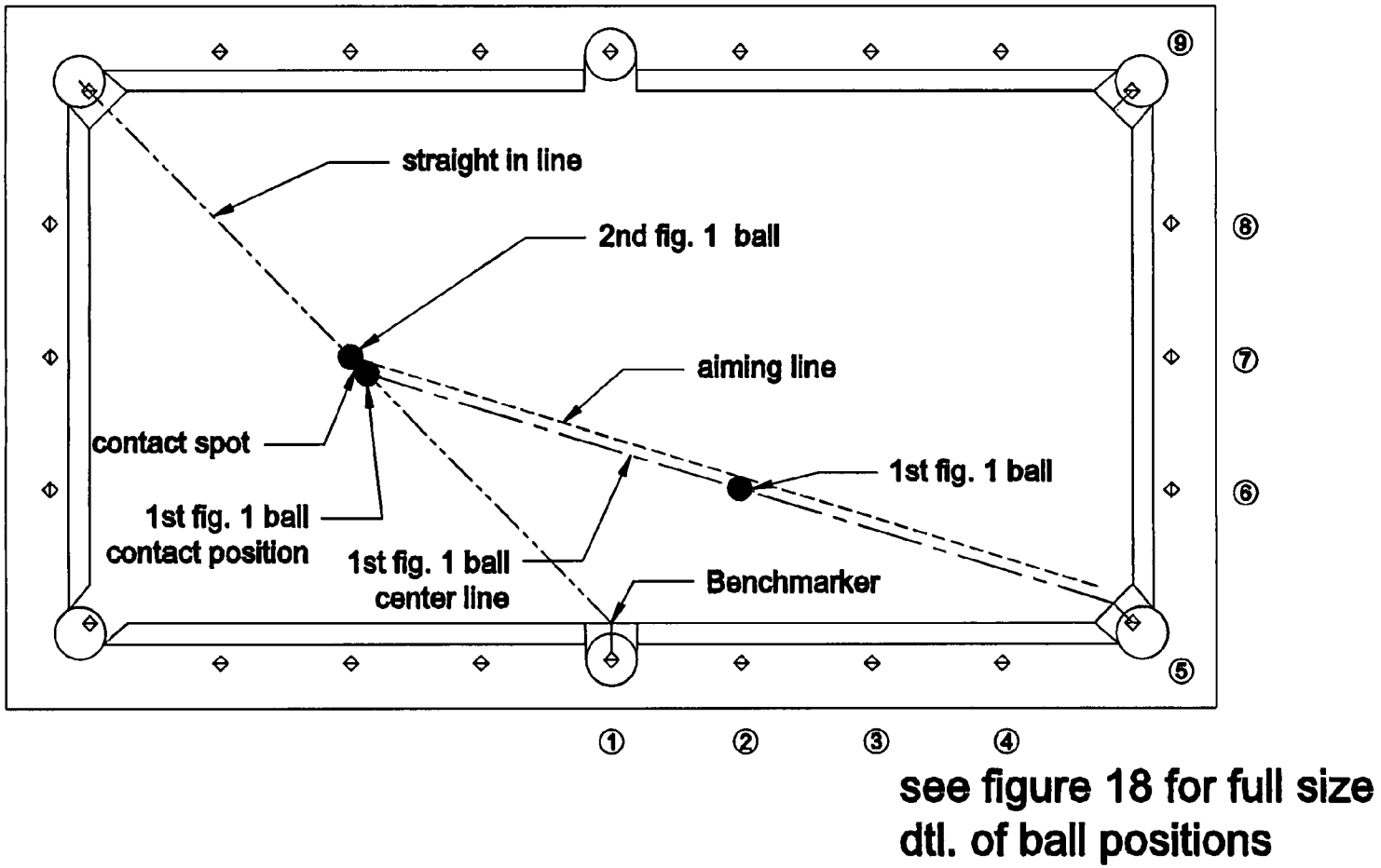
FIG. 17: drawing of 5th diamond shot on the billiard table

The drawing depicts an aiming line and a shooting line. FIG. 12, further shows the enlarged parallel lines.

FIG. 12 shows an enlarged view of FIG. 11 which shows a straight-in shot, depicting all the facets needed for this shot, the parallel lines have been enlarged for a better understanding of the invention.

In FIG. 12, Shooting two diamonds to right, the first red line on the right of the black center line on the cue ball is matched up with the black center line on object ball, the user should bend over allowing the cue stick to roll in his/her hand, the stick should then be rolled over to the center line of the cue, which in this case is the shooting line. You also can parallel step with right or left foot to shooting line, being accurate is a must for achieving the proper shot.

Figure 18:
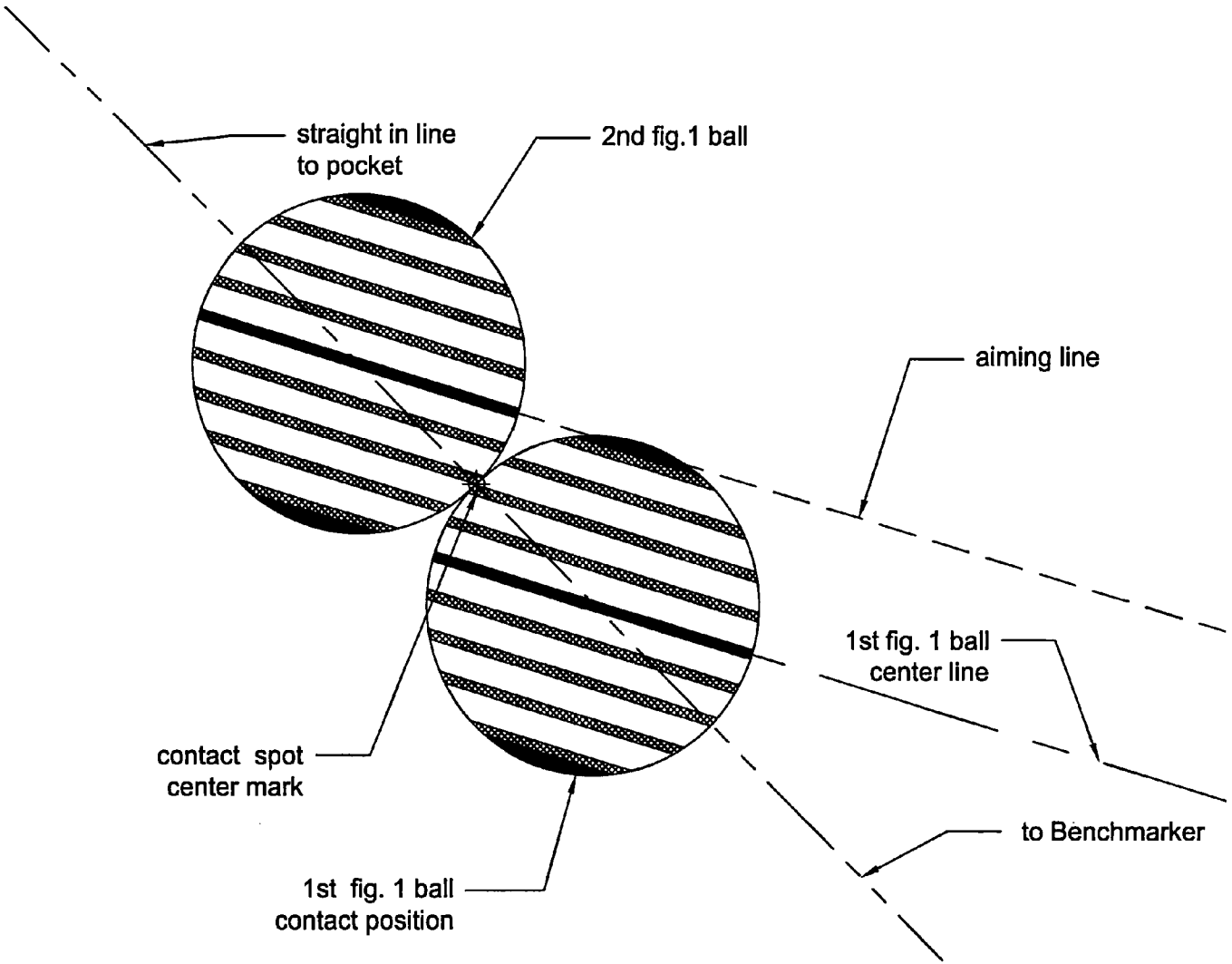
FIG. 18: enlarged drawing of 5th diamond shot ball positions

FIGS. 13-17, FIG. 17 demonstrates shot #5 half ball shot, left corner pocket to right corner pocket. Notice the parallel lines are now aiming at inside of cue ball to center of object ball. This is better observed in FIG. 18 which shows the enlarged view of the balls.

Figure 19:
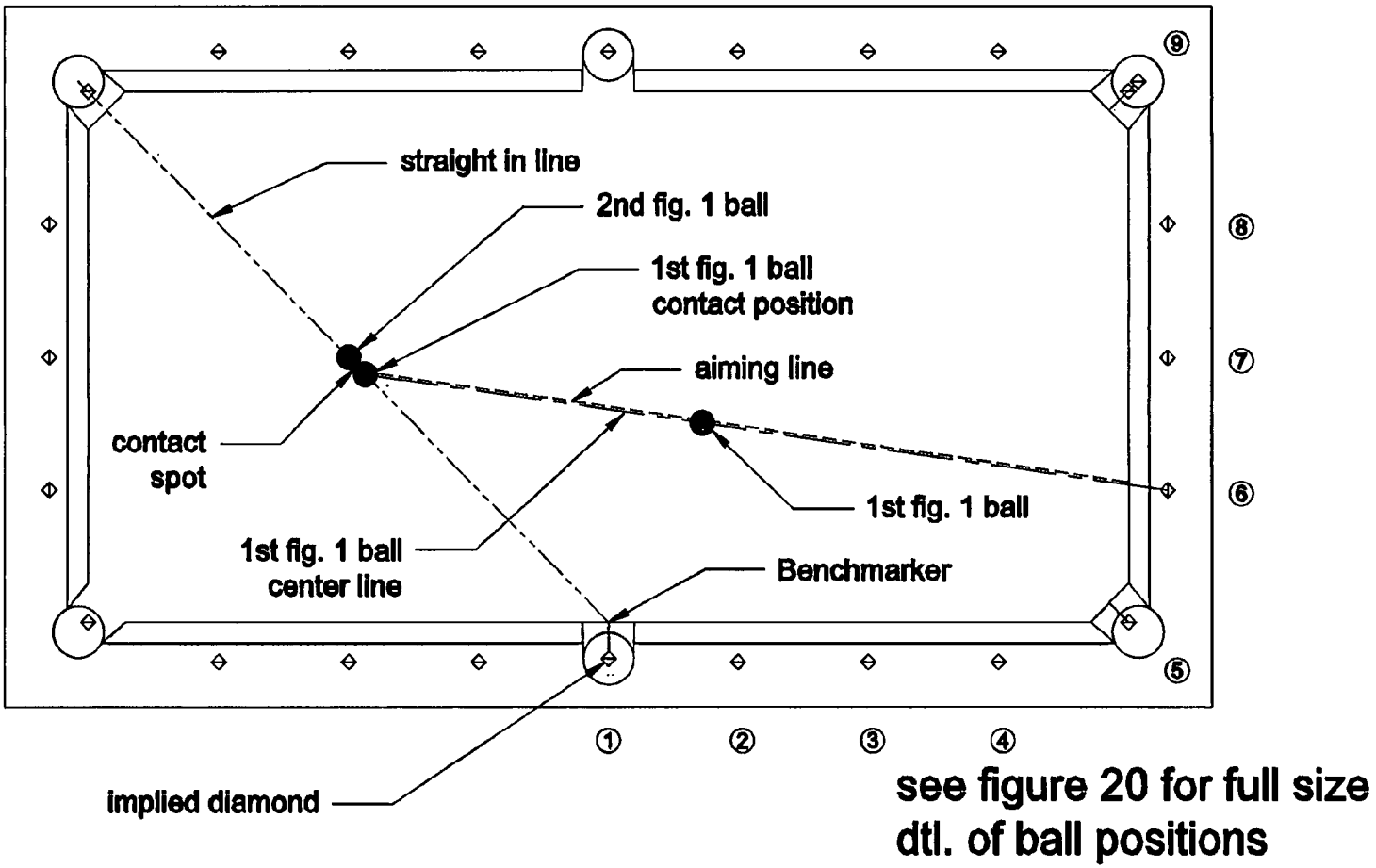
FIG. 19: drawing of 6th diamond shot on the billiard table
Figure 20:
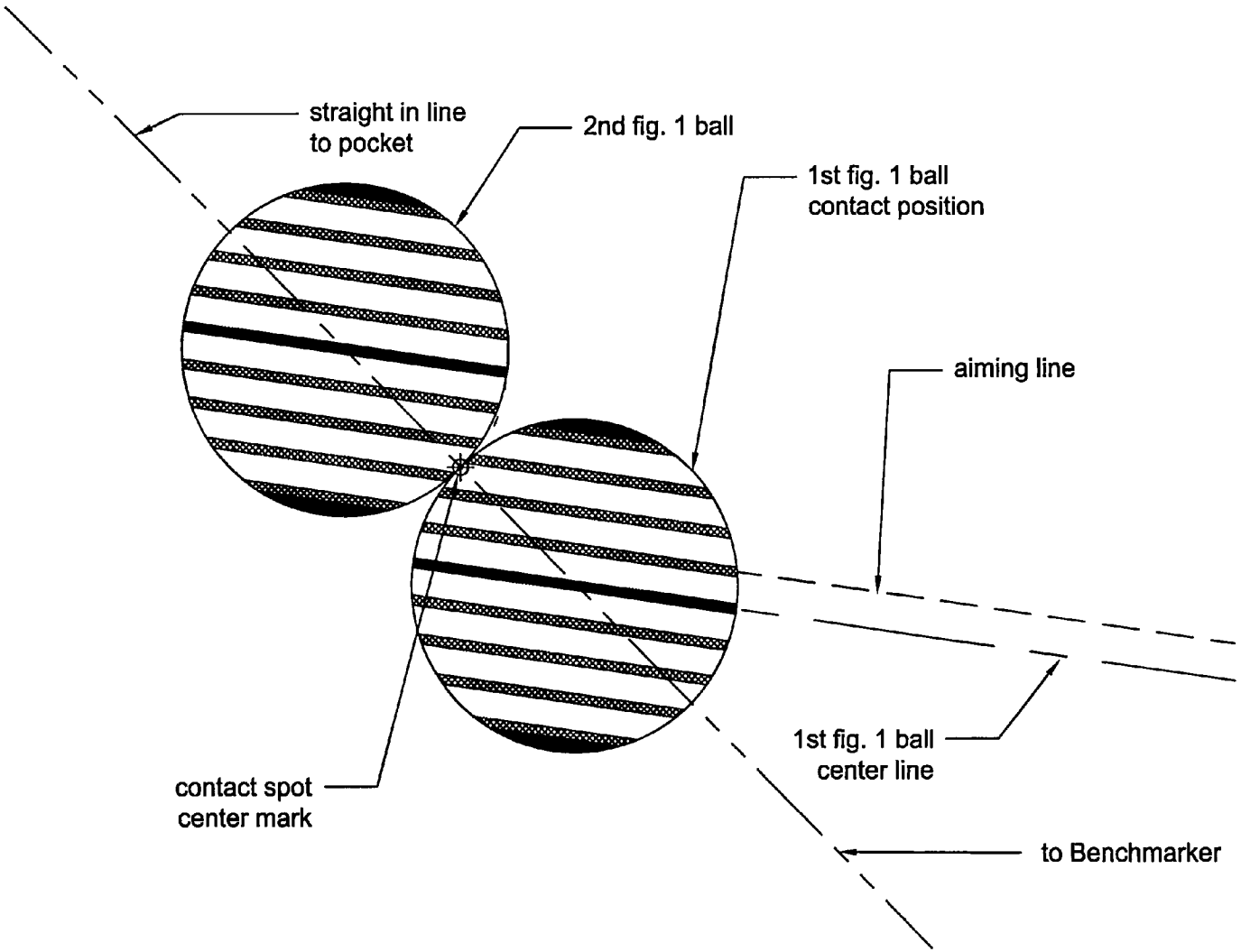
FIG. 20: enlarged drawing of 6th diamond shot ball positions
Figure 21:
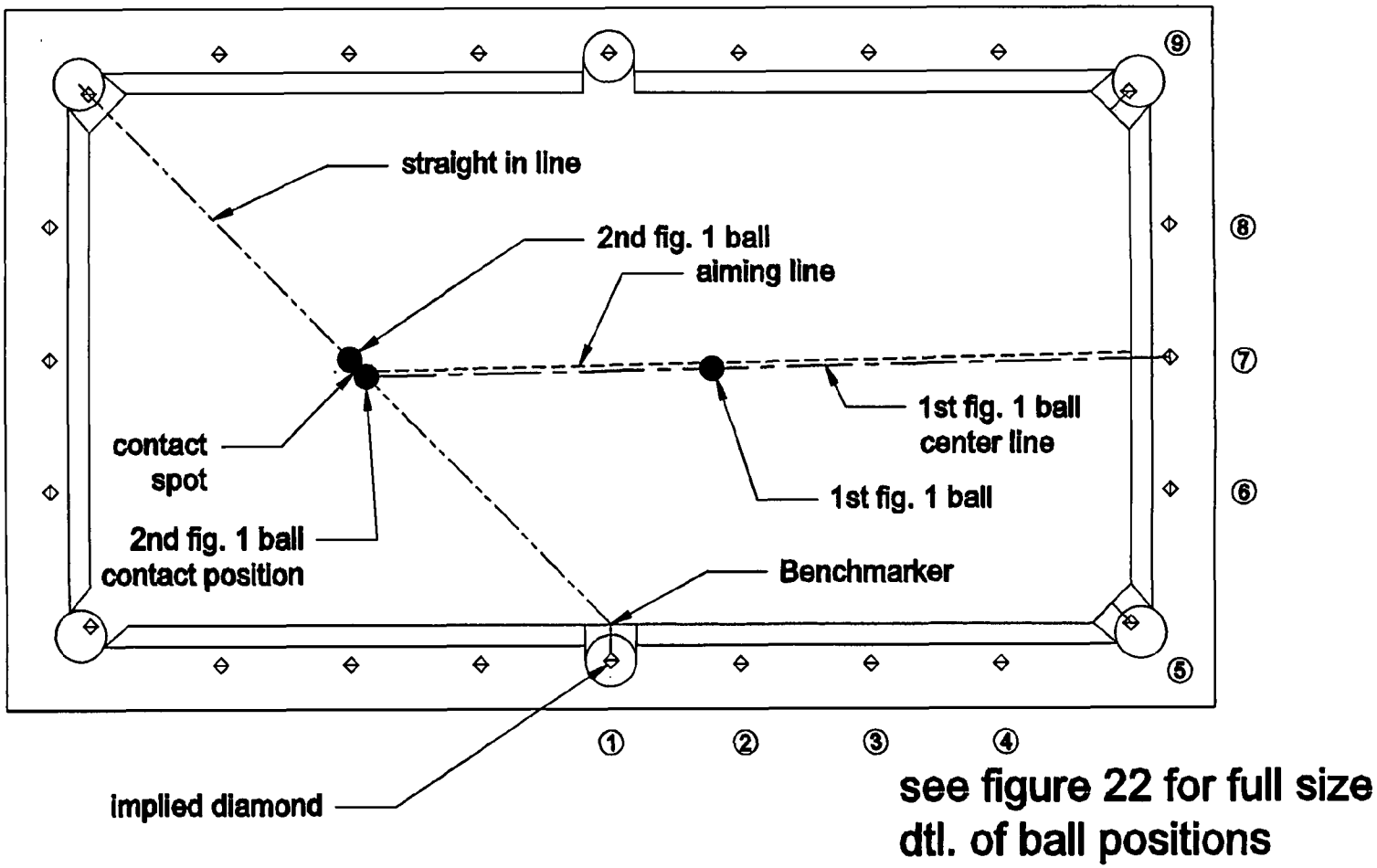
FIG. 21: drawing of 7th diamond shot on the billiard table
Figure 22:
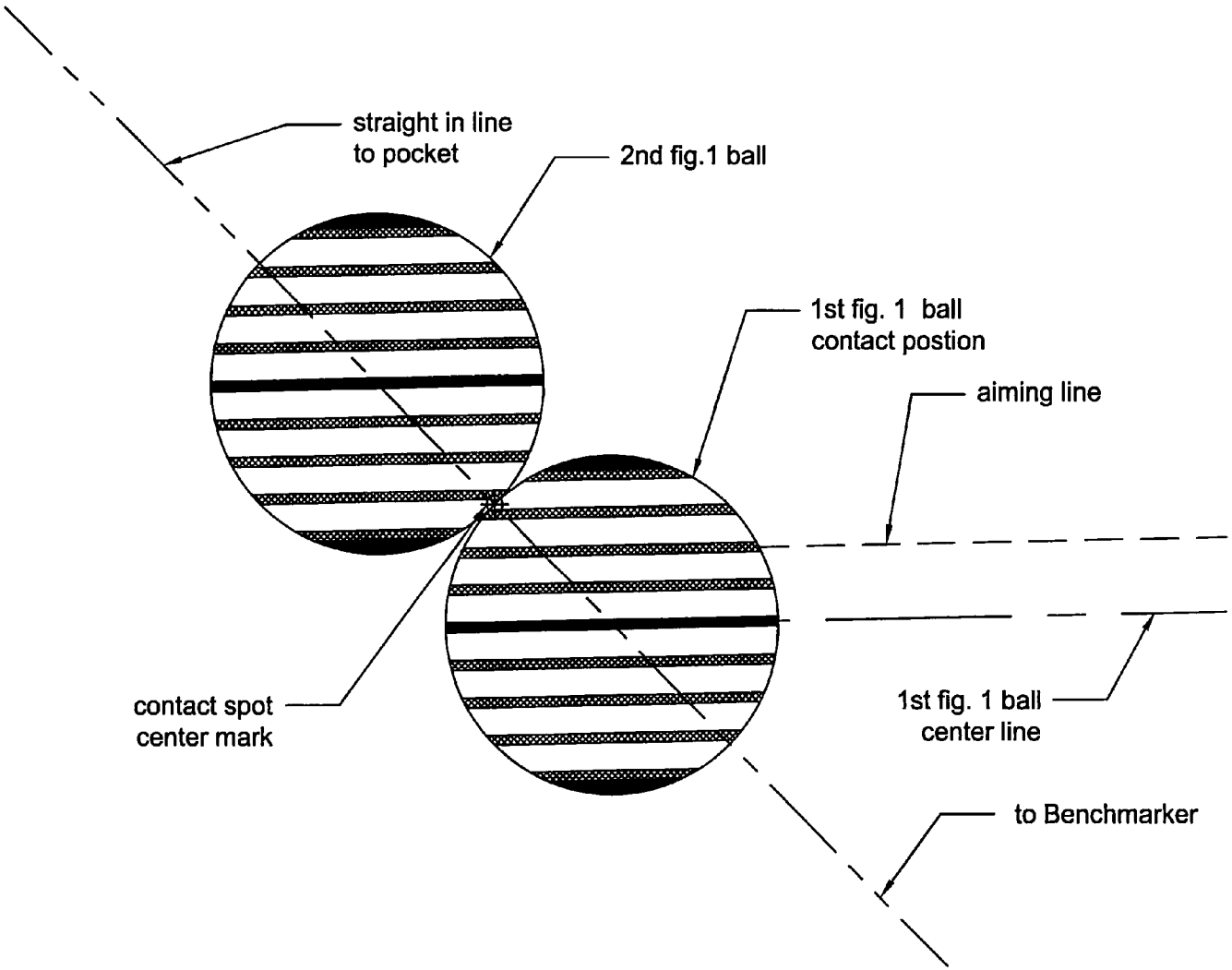
FIG. 22: enlarged drawing of 7th diamond shot ball positions
Figure 23:
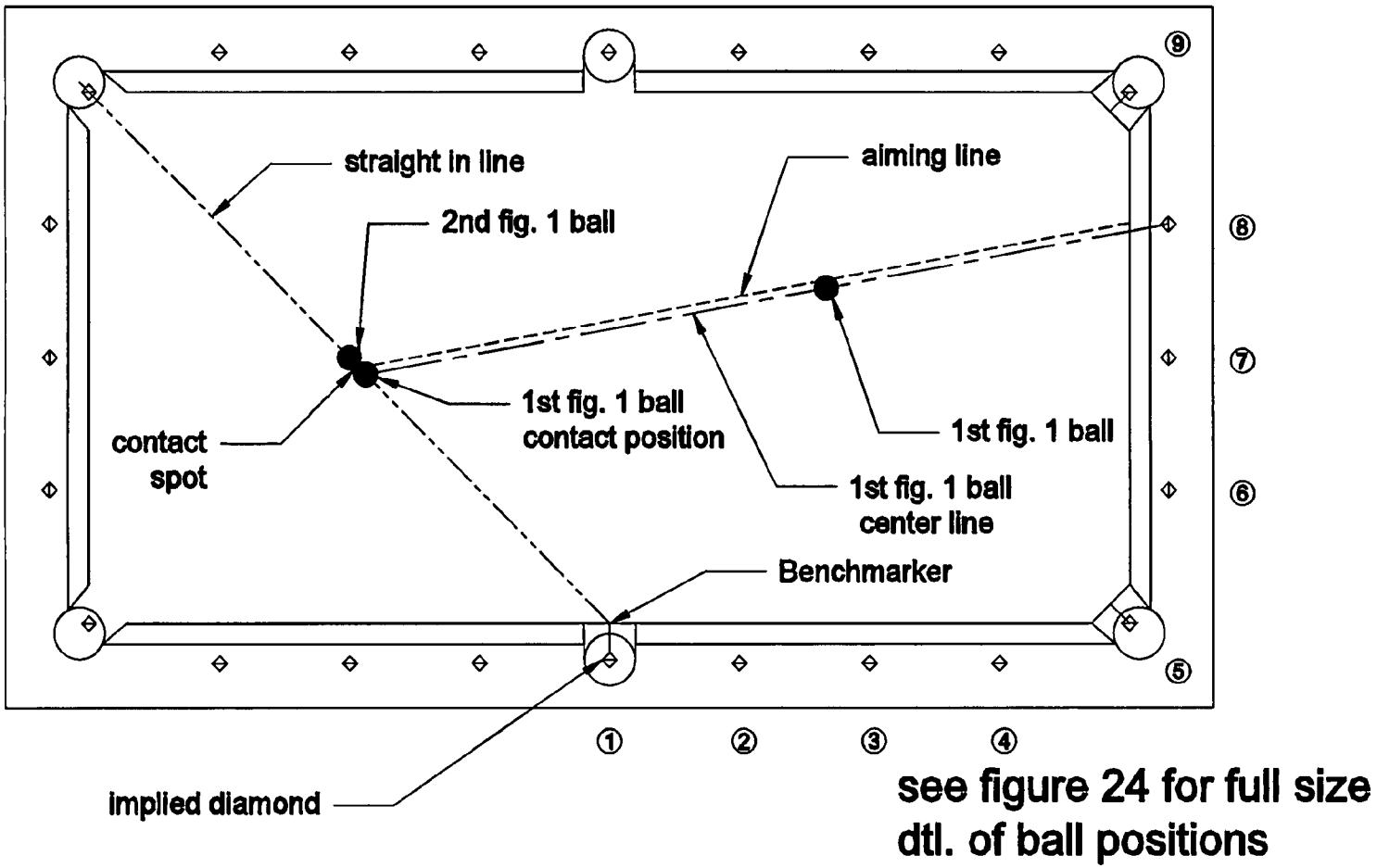
FIG. 23: drawing of 8th diamond shot on the billiard table
Figure 24:
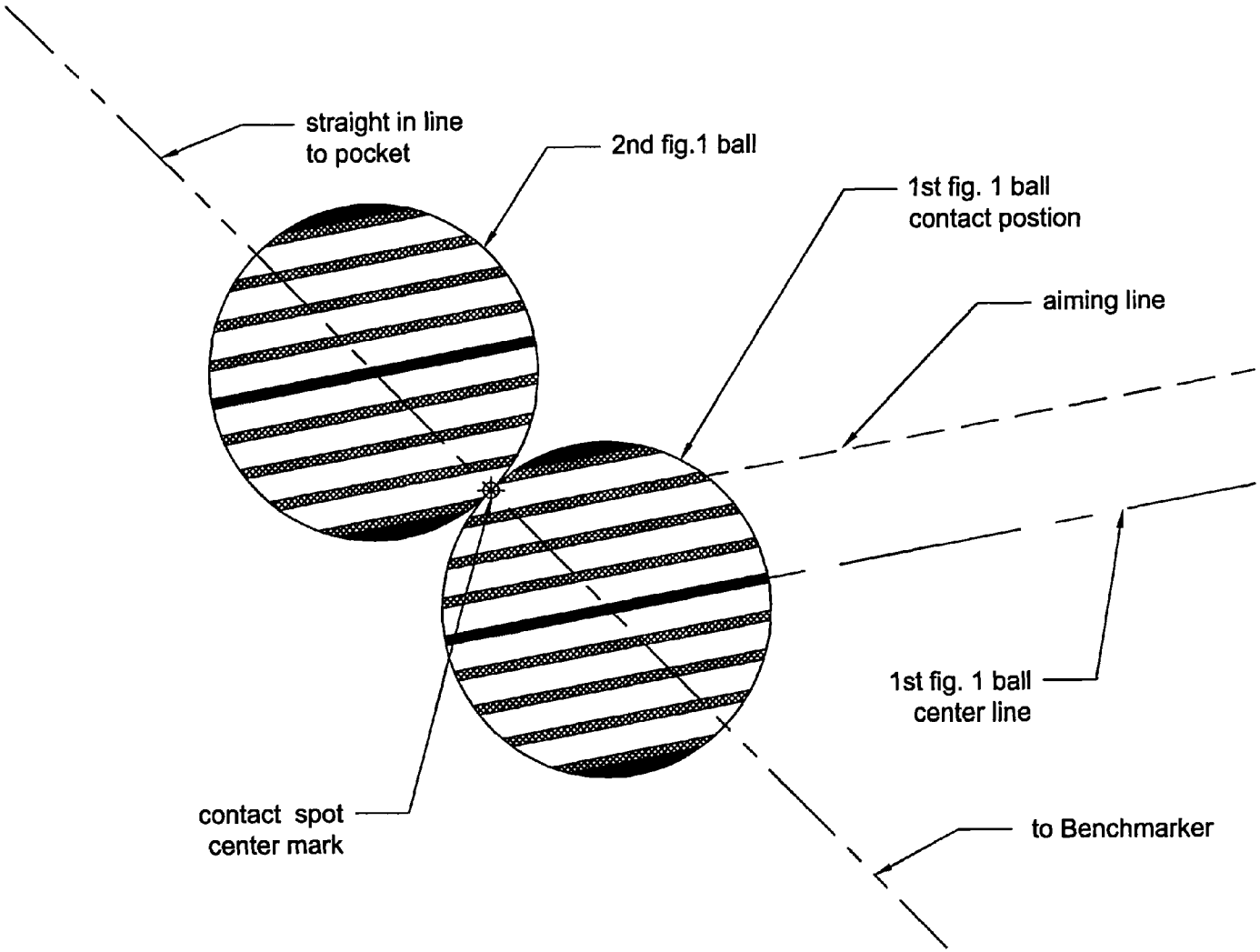
FIG. 24: enlarged drawing of 8th diamond shot ball positions
Figure 25:
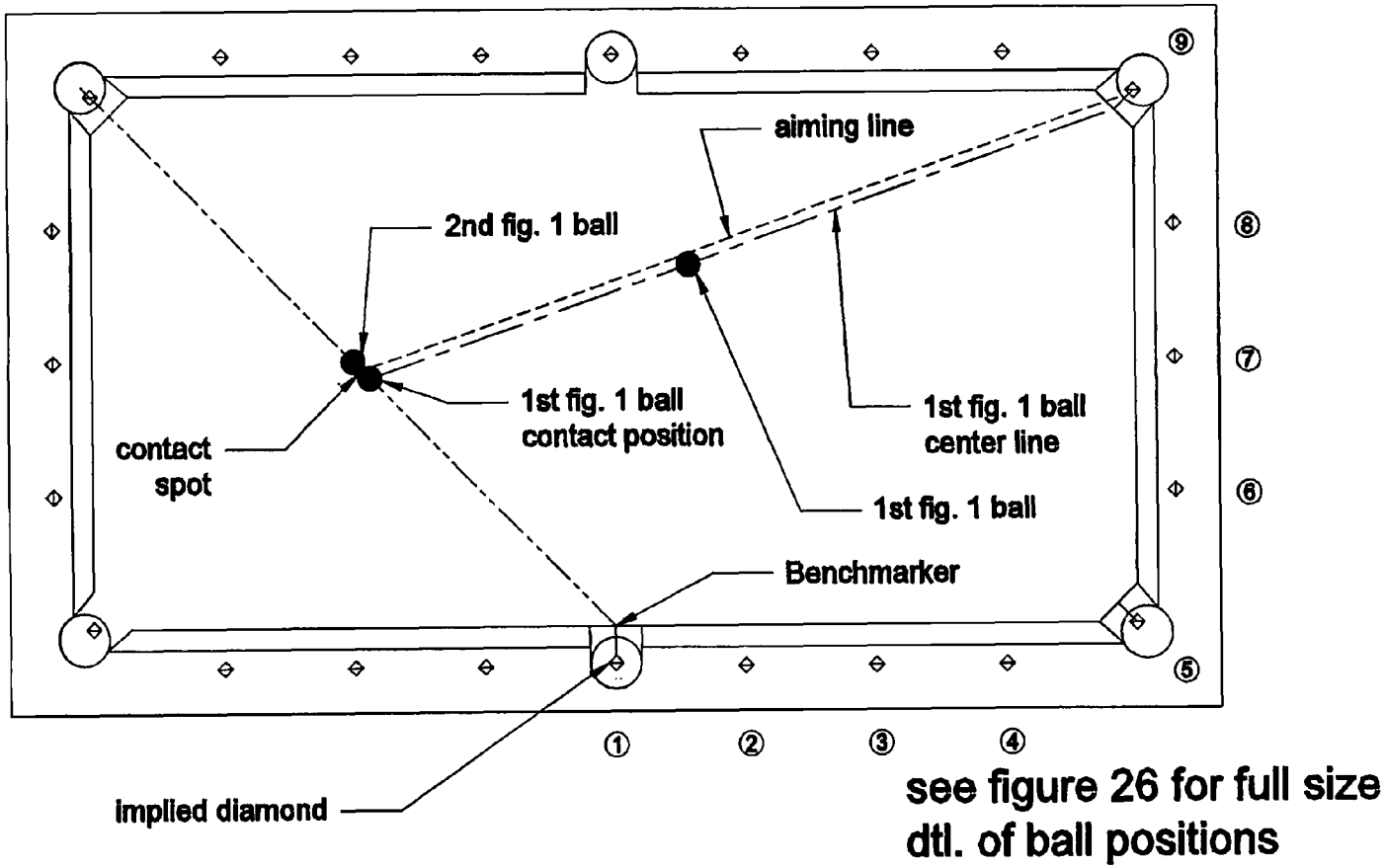
FIG. 25: drawing of 9th diamond shot on the billiard table
Figure 26:
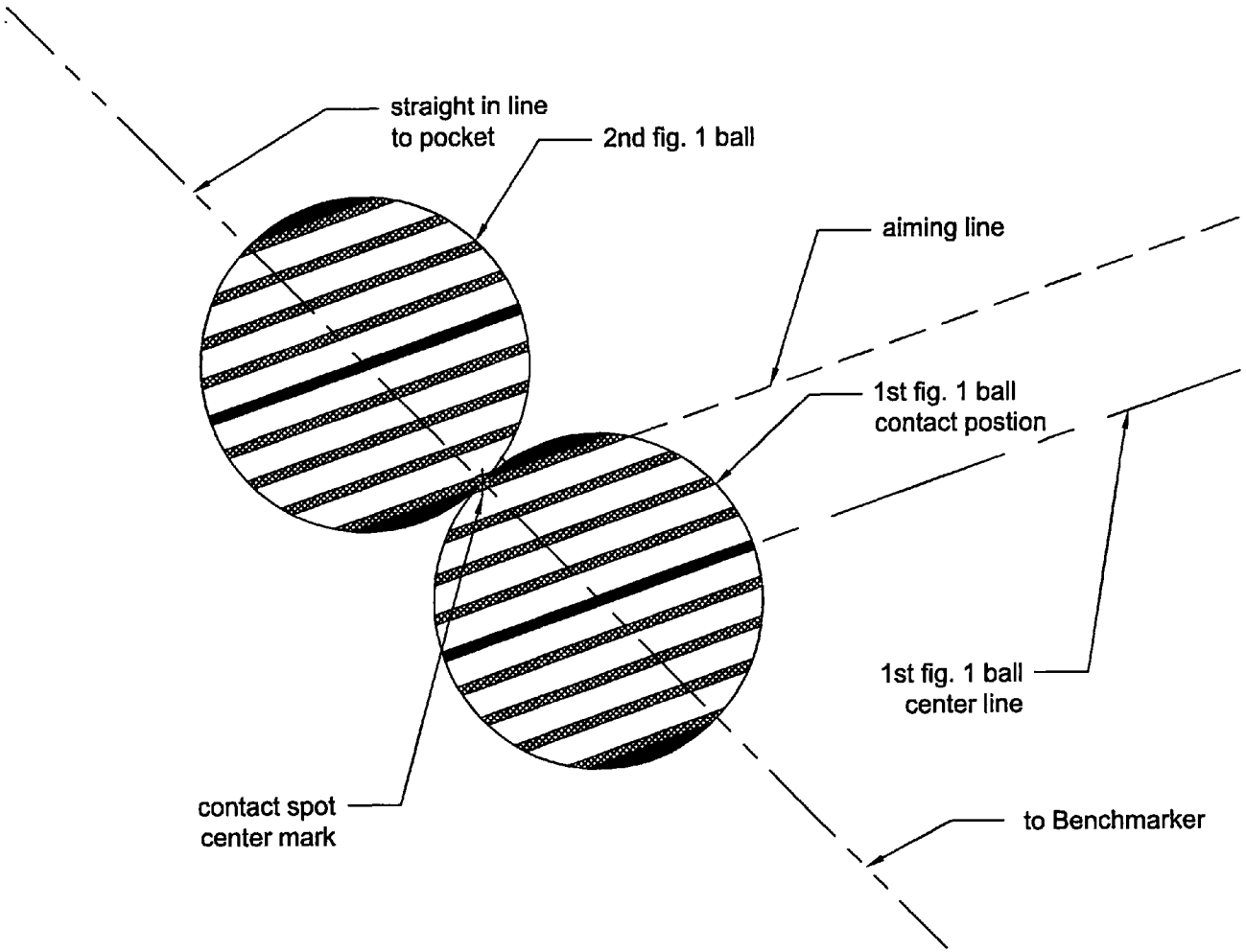
FIG. 26: enlarged drawing of 9th diamond shot ball positions

FIGS. 19 and 20, now show aiming line at outside edge of object ball and with first red line to right of black center line, then roll stick or step to center black line of cue ball, shooting line on drawing.

FIGS. 20 through 25 and 26, continue moving aiming red lines outside and roll to marker number one straight-in, first bench through nine which is 9th bench number one straight-in, first bench through nine which is 9th bench. Using the drawings as a guide line for carrying out the proper shot.

The inventive device is called "Measure Your Shot" or (M.Y.S.) for short is exactly what is says, two training balls that have nine (9) color-coded lines around the circumference of the two balls extending, 360 degrees around each of the two training balls. Nine (9) lines and a center black line which is the equator is depicted on each training ball, the right side of each ball has four (4) red lines, and a black cap is positioned on either end that is ⅛ inch, the left side cap is mirror image of the right side cap. The nine (9) lines are ¼ inch scale, which equals the scale of the diamonds on the rails on the circumference of a conventional pool table.

To begin, the user can line-up the two training balls in a straight line to any one of the table pockets, with cue stick in hand, the user will then place left hand on the stick (for right handed users, the reverse is carried out for left-handed users). At this point, the user's body and the stick become "a full unit". The user then places his/her right foot on the black center line. The user's elbow is placed against the user's hip or ribs and the user's dominant eye is focused on the center of the cue tip. The user then steps parallel with left foot and places the cue tip in line with the black center line of the training balls, as the user bends over to shoot, he/she lets the stick roll in his/her hand.

Next, the object ball is placed back on the playing surface at the previous position and the cue ball is moved to the right one diamond, the object ball and the cue ball are then positioned at the point where the black line and red lines of the training balls face each other.

The user now aims at the first red line which is positioned to the right of the black center line of the object ball, right foot on the red line toward the black center line on object ball, step straight ahead with left foot parallel and when down roll your stick back to center line on cue ball, or when you step parallel you can let the stick roll in your hand if necessary to have tip on black center line of cue, you now ready to shoot. When standing cue tip on red and pointed toward black line, notice when you are down ready to shoot you will be looking at the first red line on left of black line. You are ready to move the cue ball to second diamond, adjust balls to be straight on, and repeat the same routine again.

In order to aid the user in remembering the various types of shots, I have used a system called the "MONEY AS MY MEMORY SYSTEM":

When the balls are straight-on to shoot in the pocket, I call this a quarter shot or 0.25 cents shot.

First diamond to the left or right is the 0.50 cent shot or 2 quarters, this is two diamonds from being straight-in shot.

Third diamond is the 0.75 cent shot or three quarters from being straight-in shot.

Fourth diamond is the one dollar ($1.00) or 4 quarters from being straight in-shot.

Five diamonds is the one dollar and quarter shot ($1.25) or 5 quarters, five diamonds from being straight in shot that is the half ball shot, you are on the fifth diamond and fifth red line on cue ball aiming at black center line on object ball.

Sixth diamond is the $1.50 shot or 6 quarters, this is achieved by repeating the same exact routine, only this time you aim the first red line past the black center line at the SIDE OF OBJECT BALL, instead of the center of the object ball.

Seventh diamond is the one dollar and seventy five cent shot ($1.75) or 7 quarters, seven diamonds and lines from being straight-in.

Eight diamond is the two dollar shot ($2.00) or 8 quarters, eight diamonds and eight lines from straight-in.

Nine diamonds is the two dollar and twenty five cent shot ($2.25) or 9 quarters, nine diamonds and nine lines on the ball, in this shot the two black caps are aligned for aim.

The best method to see and recognize the shots, is to find the intended pocket to shoot the object ball in, the line will go straight through th cue ball and object ball straight back to the diamond on the rail or in the pocket. This is what is referred to as the first "benchmarker".

The second step, is to find where the cue ball and object ball meet straight on, draw another imaginary line back to the rail, where the two imaginary lines meet will determine the diamond number, this diamond is considered the second "benchmarker".

The third step is to count the diamonds between the first and second benchmarkers, this will determine the line number for lining up the balls. This aiming explanation is for the cut-shot only.

It should be noted that when the lines are in the vertical position, "curves" can be shot, by moving the cue to the right or left of the black center line, the curves become more severe toward the edges of the cue ball on the ¼ inch red lines, the attitude and stroke of the stick makes a great difference.

The training balls in this application allow a user to achieve the intended shots. By rotating the black center line or equator from the vertical position to the horizontal position the axis can be changed, allowing a user to learn the stop i.e. the cue ball is not turning in any direction, instead the ball is skidding. With the appropriate stroke, the center of the cue ball can be struck allowing the user to achieve the intended shot. The further the ball is positioned, the lower the selection of the red line with respect to the center black line, and the more difficult the stroke. Follow shots is the same, the ball is hit one red line above the black center equator, roll so far, line higher, same stroke a diamond farther, so on for gauging a stroke; drawing is below the black line, same procedure as before, using a draw stroke. Jump shot is just changing the attitude of your cue stick to steeper degree and, kind of a wrist snap shot, and the masse, is a steep attitude with cue stick with a type of fast snap follow-through.

I claim:

1. An apparatus for use on a billiard table, the billiard table comprising a plurality of pockets, a pair of side rails and a pair of end rails, a plurality of diamonds positioned on the pair of side rails and end rails, the apparatus comprising:

at least one training ball, the at least one training ball being substantially the size of a conventional billiard ball, the at least one training ball including a series of lines on an outer circumference of the training ball, the series of lines are scaled to correspond to the plurality of diamonds on the billiard table rails;

wherein the placement of the series of lines on the training ball is achieved by placing an imaginary diamond in each of the table pockets, by so doing a total of nine (9) diamonds is positioned on each side rail, wherein six (6) segments of five (5) diamonds in a row is formed on any size billiard table;

the series of lines comprise nine (9) lines, wherein the nine (9) lines extend 360 degrees around the circumference of the training ball and correspond to the nine (9) diamonds of the billiard table;

the series of nine (9) lines further comprise a center concentric ring of a first color and eight (8) concentric rings of a second color different from the first color, of the eight (8) concentric rings, four (4) of the concentric rings is positioned above the center concentric ring and the other four (4) concentric rings is positioned below the center concentric ring;

a pair of end caps also of the first color positioned on a top and bottom pole of the training ball; and wherein by using the training ball having the series of nine (9) lines in combination with the nine (9) diamonds on the billiard table, a user can practice at least nine (9) shots which can be made on any size billiard table.

2. The apparatus of claim 1, wherein the training ball is at least 2¼" and the series of nine (9) lines each have a thickness of at least ¼" and each of the end caps have a thickness of at least ⅛", wherein the series of lines are visible from a predetermined distance from the billiard table.

3. The apparatus of claim 2, wherein the at least one training ball is used in combination with two diamonds of the plurality of diamonds for making a straight-in shot.

4. The apparatus of claim 1, wherein the at least one training ball is two training balls.

5. The apparatus of claim 2, wherein the pair of end caps includes logo for advertisement.

* * * * *